US005356759A

United States Patent [19]

Mitsui et al.

[11] Patent Number: 5,356,759

[45] Date of Patent: Oct. 18, 1994

[54] COLOR REVERSAL IMAGE FORMING PROCESS USING HIGH CHLORIDE EMULSIONS AND HIGH CHLORIDE DEVELOPING SOLUTIONS

[75] Inventors: Akio Mitsui; Takatoshi Ishikawa, both of Kanagawa, Japan

[73] Assignee: Fuji Photo Film Co., Ltd., Kanagawa, Japan

[21] Appl. No.: 978,743

[22] Filed: Nov. 19, 1992

[30] Foreign Application Priority Data

Nov. 20, 1991 [JP] Japan ..... 3-332674

[51] Int. Cl.[5] ..... G03C 7/46; G03C 1/08; G03C 7/26; G03C 7/32

[52] U.S. Cl. ..... 430/379; 430/382; 430/407; 430/551; 430/611

[58] Field of Search ..... 430/379, 382, 489, 611, 430/551, 407

[56] References Cited

U.S. PATENT DOCUMENTS

| | | | |
|---|---|---|---|
| 4,720,951 | 1/1988 | Shuto et al. | 430/379 |
| 4,853,321 | 8/1989 | Momoki et al. | 430/489 |
| 5,024,925 | 6/1991 | Deguchi | 430/379 |

FOREIGN PATENT DOCUMENTS

| | | |
|---|---|---|
| 0364845 | 4/1990 | European Pat. Off. . |
| 0370351 | 5/1990 | European Pat. Off. . |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A color reversal image forming process using a color reversal photographic material is disclosed. The process comprises an exposure step, a black and white development step, a reversal step, a color development step and a desilvering step. The color reversal photographic material comprises a support and one or more silver halide emulsion layers. According to one embodiment of the present invention, at least one silver halide emulsion layer comprises silver halide containing chloride of not less than 90 mole %, iodide of 0 mole % and bromide of not more than 10 mole %. According to another embodiment, at least one silver halide emulsion layer comprises silver halide containing chloride of not less than 88 mole %, iodide of 0.1 to 2 mole % and bromide of not more than 10 mole %. The silver halide emulsion layer further contains a compound represented by the formula (Ia) or (Ib):

(Ia) (Ib)

wherein $R^{11}$ is an alkyl group, an alkenyl group, a heterocyclic group or an aryl group; $X^1$ is hydrogen, an alkali metal atom, an ammonium group or a precursor thereof; $V^1$ is an oxygen atom, a sulfur atom, =NH or $=N-(L)_n-R^{12}$; L is a divalent linking group; and n is 0 or 1.

16 Claims, No Drawings

COLOR REVERSAL IMAGE FORMING PROCESS USING HIGH CHLORIDE EMULSIONS AND HIGH CHLORIDE DEVELOPING SOLUTIONS

FIELD OF THE INVENTION

The present invention relates to a color reversal image forming method, and particularly to an image forming method which is advantageous for rapid processing and reduction of the amounts of waste liquids.

BACKGROUND OF THE INVENTION

To obtain a direct positive image without forming a negative image, there are known a color reversal film and a color reversal paper which use a reversal process. These light-sensitive materials are required to have a sufficient sensitivity and a sufficient exposure latitude because they must be subjected to direct photographic process. Further, these materials need an emulsion showing high developing effect to improve color reproducibility and sharpness of an image provided by the materials. Therefore, silver iodobromide which is advantageous for those purposes has been used as light-sensitive silver halide.

However, the silver iodobromide releases bromide ion and iodide ion into a developing solution and those ions accumulated in the solution inhibit development, resulting in the unfavorable effect that the developing speed is made slow when a number of photographic materials are processed. Therefore, the amount of replenisher is compelled to be increased to stabilize developing properties, or development inhibiting substances in an amount to be accumulated are compelled to be beforehand added to the developing solution to reduce the delay of the development in the continuous process. As a result, development of a light-sensitive material using the silver iodobromide as silver halide gives waste liquids having a large amount of BOD or COD, as compared with development of a light-sensitive material using other silver halide which releases a development inhibiting substance in a small amount.

For the same reason, it is difficult to shorten the developing period. That is, means to accelerate the developing process should be additionally taken. For example, the temperature or the pH value of the processing solution should be increased, or developing agent should be used in a large amount to shorten the developing period. However, these methods are generally accompanied by unfavorable phenomena such as increase of fogging and deterioration of photographic properties, so that a great number of technical developments are required to prevent those unfavorable phenomena.

In view of environmental influences, various means have been taken with respect to the waste photographic developing solution. For example, there has been put into practical used so-called "low replenishing method" in which a replenisher of high concentration is used in a small amount, or so-called "recycling method" in which a development inhibiting substance is removed from a recovered waste solution and the resulting solution with the consumed component such as a developing agent is recycled. In these methods, however, reduction of the amount of the waste solution has limitation because the performance of the processing solution or the photographic property is largely varied. Further, devices for recycling the waste solution cannot be easily equipped because of high cost.

In the light of the above circumstances, a light-sensitive material using silver chloride which releases a small amount of a development inhibiting substance theoretically has been paid much attention. With respect to a system wherein only a color development is carried out, such as a reproduction system of a negative type color image, there has been recently put into practical use a system wherein a light-sensitive material containing silver chloride type silver halide having advantages of silver chloride and a processing solution are used. In this system, rapid processing is possible and the amount of a waste solution can be reduced. However, in the case of a color reversal (positive type) image forming method wherein black and white development and color development are successively carried out (e.g., reversal process), such a system as mentioned above has not been accomplished yet because the use of silver chloride type silver halide causes some unfavorable effects. Especially in a system wherein the black and white development is followed by the color development, mottles (density nonuniformity of an image) of serious levels take place when the silver chloride type silver halide is used.

Use of the silver chloride type silver halide for a color reversal (positive type) light-sensitive material is described in Japanese Patent Provisional Publications No. 63(1988)-318556, No. 64(1988)-7037, No. 64(1989)-61742, No. 64(1989)-86140 and No. 2(1990)-214857, but any description on the reduction of waste solutions and improvement of mottles are not given in those publications.

SUMMARY OF THE INVENTION

The object of the invention is to provide a color reversal light-sensitive material and a color reversal image forming method by which the amount of waste solution can be made small and an image improved in occurrence of mottle can be obtained.

As results of studies on the above-mentioned problems, the present inventors have assumed that the mottle occurs by the following reason when silver chloride type silver halide is used. That is, silver chloride having a high developing activity reacts with a black and white developing solution containing a hydroquinone type or phenidone type developing agent which also has a high developing activity so that over development occurs. As a result, grains existing around the grains having been developed by the black and white development are also developed to form an original mottle. In the reversal system, silver halide remaining after the black and white development is subjected to color development to obtain an image, so that the original mottle produced by the black and white development is multiplied by the color development thereby to mar the resulting image.

For reducing or stopping occurrence of mottle caused by such mechanism, there can be thought three methods, first, a method to improve a light-sensitive material, second, a method not to produce original mottle in the black and white development, and third, a method not to multiply the original mottle caused by the black and white development in the color development. The present inventors have found an effective means for these three methods.

As results of further studies based on the above finding, the present inventors have found that an image improved in occurrence of mottle can be provided by two kinds of silver chloride type silver halide light-sensitive materials substantially not containing silver bromide, one of which contains silver halide having chloride of not less than 90 mole %, iodide of 0 mole % and bromide of not more than 10 mole % and further contains a compound represented by the aforementioned formula (Ia) or (Ib), and the other of which contains silver halide having chloride of not less than 88 mole %, iodide of 0.1 to 2 mole % and bromide of not more than 10 mole % and further contains a compound represented by the aforementioned formula (Ia) or (Ib). Thus, the present inventors have accomplished the invention.

The present invention provides a color reversal image forming process using a color reversal photographic material, which comprises an exposure step, a black and white development step, a reversal step, a color development step and a desilvering step, said color reversal photographic material comprises a support and one or more silver halide emulsion layers, wherein at least one silver halide emulsion layer comprises silver halide having chloride of not less than 90 mole %, iodide of 0 mole % and bromide of not more than 10 mole %, or comprises silver halide containing chloride of not less than 88 mole %, iodide of 0.1 to 2 mole % and bromide of not more than 10 mole %, and the silver halide emulsion layer further contains a compound represented by the formula (Ia) or (Ib):

(Ia) (Ib)

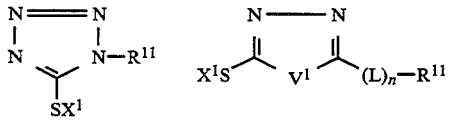

wherein $R^{11}$ is an alkyl group, an alkenyl group, a heterocyclic group or an aryl group; $X^1$ is hydrogen, an alkali metal atom, an ammonium group or a precursor thereof; $V^1$ is an oxygen atom a sulfur atom, =NH or $=N-(L)_n$, $-R^{12}$ (wherein $R^{12}$ is an alkyl group, an alkenyl group or an aryl group, and n' is 0 or 1); L is a divalent linking group such as $=N-R^{13}$, $-N(R^{13})-CO-$, $-N(R^{13})-SO_2-$, $-N(R^{14})-CO-N(R^{15})-$, $-N(R^{14})-CS-N(R^{15})-$, $-S-$, $-C(R^{13})H-$, or $-C(R^{14})(R^{15})-$ (wherein each of $R^{13}$ to $R^{15}$ independently is hydrogen, an alkyl group or an aralkyl group); and n is 0 or 1.

Preferred embodiments of the invention are described below.

(1) The black and white development step uses a processing solution which contains bromide ion of not more than $1\times10^{-3}$ mol/l and sulfite ion of not more than $1\times10^{1}$ mol/l.

(2) The black and white development step uses a processing solution which contains bromide ion of not more than $5\times10^{-4}$ mol/l and sulfite ion of not more than $1\times10^{1}$ mol/l.

(3) The black and white development step uses a processing solution which contains bromide ion of not more than $1\times10^{-3}$ mol/l and sulfite ion of not more than $2\times10^{2}$ mol/l.

(4) The black and white development step uses a processing solution which contains bromide ion of not more than $5\times10^{-4}$ mol/l and sulfite ion of not more than $2\times10^{2}$ mol/l.

(5) The black and white development step uses a processing solution which contains chloride ion of $5\times10^{-3}$ to $1\times10^{-1}$ mol/l.

(6) The black and white development step uses a processing solution which contains chloride ion of $5\times10^{-3}$ to $2\times10^{-2}$ mol/l.

(7) The black and white development step uses a processing solution which contains rhodanide ion of not more than $1\times10^{-2}$ mol/l.

(8) The black and white development step uses a processing solution which contains rhodanide ion of not more than $1\times10^{-3}$ mol/l.

(9) The color development step uses a processing solution which contains bromide ion of not more than $1\times10^{-3}$ mol/l and sulfite ion of not more than $1\times10^{-2}$ mol/l.

(10) The color development step uses a processing solution which contains bromide ion of not more than $5\times10^{-4}$ mol/l and sulfite ion of not more than $1\times10^{-2}$ mol/l.

(11) The color development step uses a processing solution which contains bromide ion of not more than $1\times10^{-3}$ mol/1 and sulfite ion of not more than $5\times10^{-3}$ mol/l.

(12) The color development step uses a processing solution which contains bromide ion of not more than $5\times10^{-4}$ mol/l and sulfite ion of not more than $5\times10^{-3}$ mol/l.

(13) The color development step uses a processing solution which contains chloride ion of $5\times10^{-3}$ to $1\times10^{-1}$ mol/l.

(14) The color development step uses a processing solution which contains rhodanide ion of not more than $1\times10^{-2}$ mol/l.

(15) The color development step uses a processing solution which contains rhodanide ion of not more than $1\times10^{-3}$ mol/l.

(16) Each of the black and white developing solution and the color developing solution independently contains bromide ion of not more than $1\times10^{-3}$ mol/l.

(17) Each of the black and white developing solution and the color developing solution independently contains bromide ion of not more than $5\times10^{-4}$ mol/l.

According to the color reversal image forming method of the invention, an amount of a waste solution can be reduced, and occurrence of mottle can also be reduced to obtain an improved clear image.

DETAILED DESCRIPTION OF THE INVENTION

The color reversal light-sensitive material of the invention contains a compound represented by the following formula (Ia) or (Ib).

(Ia) (Ib)

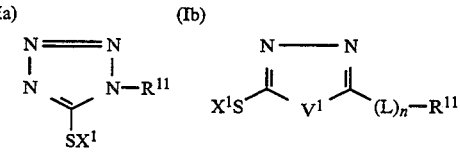

In the formula (Ia), $R^{11}$ is an alkyl group, an alkenyl group, a heterocyclic group or an aryl group. $X^1$ is hydrogen, an alkali metal atom (e.g., sodium, potassium), an ammonium group (e.g., tetramethylammonium group, triemethylbenzylammonium group) or a precursor thereof. The precursor means a group in which $X^1$ can be hydrogen or an alkali metal atom under the alkaline condition. Examples of the precursor include acetyl, cyanoethyl and methanesulfonylethyl. The alkyl or alkenyl groups indicated by $R^{11}$ may be substituted or unsubstituted, and further may be an alicyclic group. Examples of substituent groups of the alkyl group include a halogen atom, nitro, cyano, hydroxyl, an alkoxy group, an aryl group, an acylamino group, an alkoxycarbonylamino group, a ureido group, an amino group, a heterocyclic group, an acyl group, a sulfamoyl group, a sulfonamide group, a thioureido group, a carbamoyl group, an alkylthio group, an arylthio group, a heterocyclic thio group, carboxyl, sulfonyl and salts of carboxyl or fulfonyl. Each of the ureido, amino, sulfamoyl, thioureido and carbamoyl groups may be unsubstituted, and may include N-alkyl substituted and N-aryl substituted groups. Examples of the aryl group include phenyl, a substituted phenyl group and naphthyl. Examples of substituent groups of phenyl include alkyl group and the above-exemplified substituent groups for the alkyl group. An example of the heterocyclic group indicated by $R^{11}$ is pyridine group.

In the formula (Ia), a phenyl group substituted with amide group or ureido group is particularly preferred as $R^{11}$.

Details of an alkyl group, an aryl group indicated by each of $R^{11}$ to $R^{15}$ in the formula (Ib) are the same as those in the formula (Ia) described above. In the formula (Ib), L is preferably —CO— or —N($R^{14}$)—CO—N($R^{15}$)—.

An amount of the compound represented by the formula (Ia) or (Ib) is preferably in the range of $1\times10^{-5}$ to $1\times10^{-2}$ mol, more preferably $1\times10^{-4}$ to $1\times10^{-2}$ mol, per 1 mol of the silver halide.

Examples of the compounds represented by the formula (Ia) or (Ib) include compounds of (A-366) to (A-530), (A-3), (A-592) to (A-644), (A-729) to (A-746) and (A-795) to (A-812) described at pages 51–68 of Japanese Patent Provisional Publication No. 62(1987)-215272.

Examples of the compounds represented by the formula (Ia) or (Ib) are shown below.

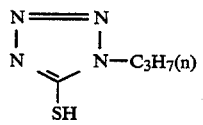
(1)

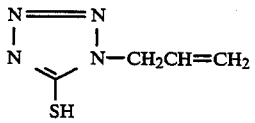
(2)

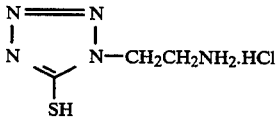
(3)

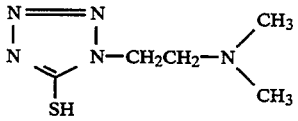
(4)

-continued

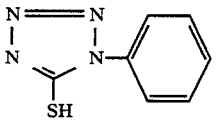
(5)

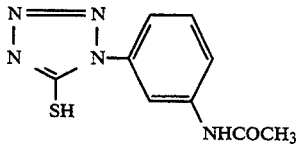
(6)

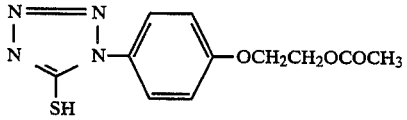
(7)

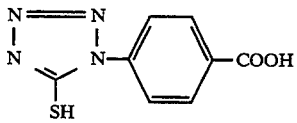
(8)

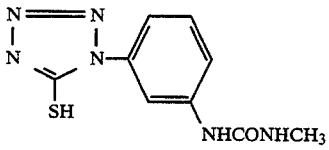
(9)

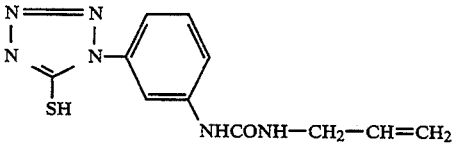
(10)

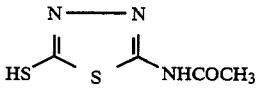
(11)

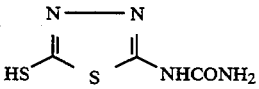
(12)

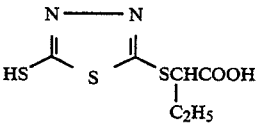
(13)

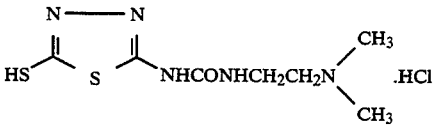
(14)

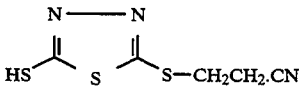
(15)

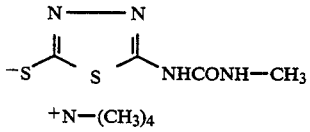
(16)

-continued (17)

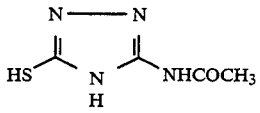

(18)

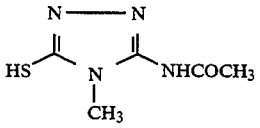

(19)

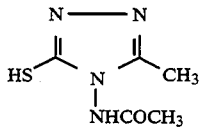

(20)

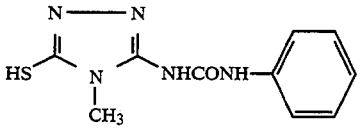

(21)

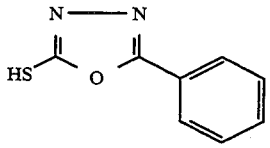

The compounds (6), (9) and (18) are particularly preferred.

The process of the present invention is described in more detail.

The silver halide emulsion used for the color reversal light-sensitive material of the invention is a silver chloride type silver halide emulsion which substantially does not contain silver bromide. The silver halide emulsion comprises two kinds of halide compositions. One is silver halide containing chloride of not less than 90 mole %, iodide of 0 mole % and bromide of not more than 10 mole % (which is referred to as "silver chloride" hereinafter in this specification). The other is silver halide containing chloride of not less than 88 mole %, iodide of 0.1 to 2 mole % and bromide of not more than 10 mole % (this silver halide is referred to as "silver iodochloride" hereinafter).

The expression "substantially does not contain silver bromide" means that a molar content of silver bromide is not more than 10 mole %, preferably not more than 5 mole %, and more preferably not more than 2 mole %.

The silver chloride emulsion of the invention is a silver chloride emulsion having a high content of silver chloride in which the content of silver chloride is not less than 90 mole %. The molar content of silver chloride is preferably not less than 95 mole %, more preferably not less than 98 mole %.

The silver iodochloride emulsion of the invention is an emulsion having a high content of silver chloride in which the content of silver iodide is in the range of 0.1 to 2 mole % and the content of silver chloride is at least 90 mole %. The molar content of silver chloride is preferably not less than 94 mole %, and more preferably not less than 97 mole %.

The crystal structure of the emulsion grains of the invention may be either homogeneous or heterogeneous. In the heterogeneous structure, the halogen compositions inside and outside are different from each other. The crystal may have a layered structure of three or more layers.

Accordingly, the grains in the silver halide emulsion of the invention can have a certain distribution or a certain structure with respect to the halogen composition. Typical examples of such grains are a core/shell type or double-structure type grain in which halogen compositions inside and outside are different from each other as described in Japanese Patent Publication No. 43(1968)-13162, and Japanese Patent Provisional Publications No. 61(1986)-215540, No. 60(1985)-222845 and No. 61(1986)-75337. In these grains, a shape of the core may be the same or different from that of the whole grain with shell. Concretely, when the core is in the shape of cube, the grain with shell may be in the shape of cube or octahedron. Further, the grain may be not only the double-structure type but also triple-structure type described in Japanese patent Provisional Publication No. 60(1985)-222844 or multi-layer structure type. Furthermore, the surface of the double-structure grain of core/shell type may be provided with a thin layer of silver halide having different composition.

The inside structure of the grain may be the above-mentioned enclosed structure or may be so-called "bonding structure". Grains having the bonding structure are disclosed in, for example, Japanese Patent Provisional Publications No. 59(1984)-133540 and No. 58(1983)-108526, EP199290A2, Japanese Patent Publication No. 58(1983)-24772 and Japanese patent Provisional Publication No. 59(1984)-16254. A crystal having different composition from the host crystal is bonded to an edge portion, a corner portion or a surface portion of the host crystal to form a grain of bonding structure. In this case, halogen conversion initiation inhibitors, which are adsorbing organic compounds, such as mercaptoazoles described in Japanese Patent Provisional Publication No. 1(1989)-102453, nucleic acid decomposition products and dyes may be used on the surface of the host crystal. These halogen conversion initiation inhibitors are useful also in the case of subjecting the host crystal to halogen conversion. Such bonding type crystal as mentioned above can be formed even when the host crystal has a homogeneous halogen composition or has a core/shell type structure.

In the case of the bonding structure, not only a combination of silver halides but also a combination of silver halide and a silver salt compound not having a rock salt structure (e.g., silver rhodanate and silver carbonate) is available. Further, a non silver salt compound such as PbO may be used if bonding of the compound to silver halide is possible.

The grains having the above structures, for example, grains of core/shell type structure may have a high content of silver iodide or silver bromide in the core and a low content thereof in the shell. On the contrary, the grains may have a low content of silver iodide or silver bromide in the core and a high content thereof in the shell. Similarly, the grains having bonding structure may have a high content of silver iodide or silver bromide in the host crystal and a relatively low content thereof in the crystal bonded to the host crystal. Otherwise, the grains may have a reverse relation to the relation described above.

The grains having the above structures may have an apparent boundary between the different halogen compositions, or may have a vague boundary therebetween by forming mixed crystals having different compositions. Further, the grains may be positively provided with a continuous structural change.

In the invention, an emulsion containing grains having a certain structure with respect to halogen composition is preferably used as compared with an emulsion containing grains having a homogeneous halogen composition. Particularly preferred are grains having such a halogen composition that silver iodide is contained in a smaller amount inside of the grain than outside thereof. A typical example of the emulsion is a core/shell type emulsion in which a content of silver iodide in the core of the grain is higher than that in the shell of the grain. A molar ratio between the core and the shell is optionally determined between 0:100 and 100:0, but preferably the molar ratio is in the range of 3:97 to 98:2 because the grain having such ratio can be clearly differentiated from a grain having homogeneous halogen composition. In the case where the shell is formed by so-called "halogen conversion" which utilizes a difference of solubility between silver halides, the molar ratio between the core and the shell may be smaller than 98:2, though the core is not uniformly covered with the shell. The molar ratio between the core and the shell is more preferably in the range of 5:95 to 85:15, most preferably 15:85 to 70:30. A difference between the content of silver iodide or silver bromide in the core and that in the shell varies depending on the molar ratio between the core and the shell, but it is preferably not less than 0.1 mole %, more preferably not less than 0.5 mole %.

The silver iodide grains or silver bromide grains used in the invention can be selected from those of normal crystal containing no twinned crystal plane, those of single twinned crystal having one twinned crystal plane, those of parallel multiple twinned crystal having two or more parallel twinned crystal planes and those of non-parallel multiple twinned crystal having two or more non-parallel twinned crystal planes, depending on the purpose. These twinned crystals are described in "Basic Silver Salt Photograph of Photographic Industry" ed. Japan Photographic Institute (published by Corona Sha, p. 163). In the case of normal crystals, there can be used grains of (100) cube made of planes, (111) octahedron made of planes, and (110) dodecahedron made of planes which is disclosed in Japanese Patent Publication No. 55(1980)-42737 and Japanese Patent Provisional Publication No. 60 (1985)-222842. Further, (hll) plane grain represented by (211), (hhl) plane grain represented by (331), (hko) plane grain represented by (210), and (hkl) plane grains represented by (321), which are reported in "Journal of Imaging Science", vol. 30, p. 247 (1986), can be also used depending on the purpose, although the preparation thereof should be improved. Also employable depending on the purpose are a grain of tetradecahedron in which planes of (100) and planes of (111) exist together in one grain, a grain in which planes of (100) and planes of (110) exist together, a grain in which planes of (111)and planes of (110) exist together, and a grain in which two planes or plural planes exist together.

The shape of the silver halide grain used in the invention may be tetradecahedron or dodecahedron other than the above-mentioned cube or octahedron. Further the grain is in the irregular shape. Particularly in the case of the bonding type grain, it does not have a regular shape but has an irregular shape in which a bonding crystal is uniformly produced on the corner portion, edge portion or plane of the host crystal. The grain may be spherical. In the invention, a cubic grain and an octahedral grain are preferably used. A tabular grain is also preferably used. Particularly, an emulsion containing the tabular grains having a ratio of grain diameter (in terms of circle) to grain thickness of not less than 2, preferably in the range of 2 to 15, more preferably in the range of 3 to 8, in an amount of not less than 50% of projected area of all grains is excellent in the rapid developing properties. A tabular grain having the aforementioned structure is also useful.

The silver iodochlorobromide emulsion may be subjected to a treatment to make the grains rounded as disclosed in EP-0096727B1 and EP-0064412B1 or a treatment to modify the grain surface as disclosed in DE-2306447C2 and Japanese Patent Provisional Publication No. 60(1985)-221320.

The silver halide emulsion can be prepared in accordance with a method described in, for example, "Chimie et Physique Photographique" by P. Glafkides, Paul Montel, 1967; "Photographic Emulsion Chemistry" by G. F. Duffin, Focal Press, 1966; or "Making and Coating Photographic Emulsion" by V. L. Zelikman et al., Focal Press, 1964. Namely, any of acid process, neutral process and ammonia process can be used. A soluble silver salt can be reacted with a soluble halogen salt in accordance with any of one side mixing method, simultaneous mixing method and a combination of them. Further, a process in which grains are formed in the presence of excess silver ion (so-called "reversal mixing method") is also available. A so-called "controlled double jet method", which is a kind of simultaneous mixing method, can also be used. In this method, pAg value of the liquid phase in which silver halide is formed is kept at a constant value. In accordance with the controlled double jet method, a silver halide emulsion in which silver halide grain has a regular crystal form and the grain size is almost uniform can be prepared.

It is also effective in case of necessity that two or more kinds of only one or both of an aqueous solution of soluble silver salt and an aqueous solution of soluble alkali halide are prepared and concentrations or compositions of those two or more kinds of the aqueous solutions are varied. One example of such process is an addition method described in Japanese Patent Publication No. 61(1986)-31454, and this addition method can be used if necessary. A method of accelerating the addition speed with time described in Japanese Patent Publication No. 48(1973)-36890 and a method of increasing the addition concentration described in U.S. Pat. No. 4,242,445 are also preferably used to prepare the silver iodochlorobromide emulsion employable in the invention. In the preparation of the silver iodochlorobromide employable in the invention, it is also preferred to subject a part of grains to conversion process with different anion in the grain formation stage or in an appropriate stage after the grain formation stage. After the grain formation stage, the conversion process can be carried out after desilvering process and before chemical ripening process. Further, the conversion process may be carried out in chemical ripening process, after chemical ripening process, or before coating process. Preferably, the conversion process is carried out before chemical sensitization or before dye adsorption. As the anion for the conversion process, preferably used is a compound which forms slightly soluble silver salt from the used silver chloride grain.

Two or more kinds of anions can be used in combination. The amount of anion is in the range of 0.01 to 10 5 by mol, preferably 0.1 to 3 mole %, based on the total amount of the silver halides. It is particularly preferred to localize a portion having a high content of silver iodobromide in the silver iodochlorobromide grain using a method described in Japanese Patent Provisional Publication No. 62(1987)-7040.

To form a layer mainly containing localized silver iodobromide, water-soluble silver salt and water-soluble iodide salt (or bromide salt) may be added to form a shell after the formation of high silver chloride grain, or only water-soluble iodide salt (or bromide compound) is added to perform heat ripening after the formation of high silver chloride grain.

In the formation of the silver halide grains or the physical ripening thereof, cadmium salt, zinc salt, lead salt, thallium salt, iridium salt, iridium complex salt, iron salt, or iron complex complex salt may be used.

Iridium salt is used in an amount of $10^{-9}$ to $10^{-4}$ mol, preferably $10^{-8}$ to $10^{-5}$ mol, per 1 mol of the silver halide. An emulsion obtained by using the iridium salt is very useful for obtaining rapid development properties and stability at high illuminance or low illuminance deviating from proper exposure illuminance region, as compared with an emulsion obtained by using no iridium salt.

In order to improve reciprocity law failure, an emulsion doped with a large amount of a polyvalent impregnating ion as described in Japanese Patent Provisional Publication No. 62(1987)-260137 is preferably used as the silver iodochlorobromide emulsion of the invention.

The emulsion has a concentration of the chloride of preferably not more than 5 mol/liter, more preferably in the range of 0.07 to 3 mol/liter, in the grain formation stage of the invention in each case. A temperature of the emulsion in the grain formation stage is in the range of 10° to 95° C., preferably 40° to 90° C. There is no specific limitation on a pH value of the emulsion in the grain formation stage, but the pH value is preferably neutral to weak acid.

After the grain formation, the silver halide emulsion is subjected to normal physical ripening, desilvering process and chemical ripening, and then subjected to coating process.

When the physical ripening is carried out in the presence of a known solvent for silver halide (e.g., ammonia, potassium rhodanate, or thioethers and thion compounds described in U.S. Pat. No. 3,271,157, and Japanese Patent Provisional Publications No. 51(1986)-12360, No. 53(1988)-82408, No. 5391988)-144319, No. 54(1989)-100717 and No. 54(1989)-155828), a monodispersed emulsion containing grains having regular crystal form and almost uniform grain size distribution can be obtained. Soluble silver salt can be removed from the emulsion before or after physical ripening in accordance with a noodle washing method, a flocculation sedimentation method or an ultrafiltration method.

A mean grain size of the silver halide grains is preferably in the range of 0.1 to 2 μm, more preferably in the range of 0.15 to 1 μm. When the grain is spherical or nearly spherical, the mean grain size is a mean grain diameter, and when the grain is cubic, the mean grain size is a mean edge length, each based on projected area. The grain size distribution may be either narrow or wide. Preferred is such a narrow grain size distribution that the sizes of not less than 90%, preferably not less than 95%, by weight or by number of all grains is within the range of ±20% of the mean grain size. That is, a monodispersed silver halide emulsion is preferred. In order to obtain an aimed gradation of an image provided by a light-sensitive material, it is preferred that two or more kinds of monodispersed silver halide emulsions which are substantially the same in the color sensitivity but different in the grain size distribution are mixed and coated to form a single emulsion layer, or coated to form an emulsion layer of multi-layer structure. It is also preferred to use a combination of two or more kinds of polydispersed silver halide emulsions or a combination of a monodispersed emulsion and a polydispersed emulsion to form a single emulsion layer or an emulsion layer of multi-layer structure.

In the invention, it is particularly preferred to use two or more kinds of monodispersed emulsions to form a single emulsion layer or an emulsion layer of multi-layer structure.

As a protective colloid employable for preparing the silver iodochloride emulsion used in the invention or as a binder of other hydrophilic colloidal layers, gelatin is advantageously employed, but other hydrophilic colloids than gelatin can be also employed.

For example, there can be employed proteins such as gelatin derivative, graft polymer of gelatin and other polymer, albumin and casein; cellulose derivatives such as hydroxyethyl cellulose, carboxymethyl cellulose and cellulose sulfates; sugar derivatives such as alginic acid soda and starch derivative; various synthetic hydrophilic polymer materials (homopolymers or copolymers) such as polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

Lime-treated gelatin and acid-treated gelatin described in "Bull. Soc. Sci. Phot. Japan", No. 16, p. 90 are also employable as gelatin. Further, a hydrolysis product of gelatin or an oxygen decomposition product is also employable.

After the grain formation, the emulsion of the invention is subjected to chemical ripening. Gold sensitization using a metal compound for the chemical ripening can be carried out in accordance with a method described in, for example, U.S. Pat. Nos. 2,448,060 and 3,320,069.

Gold complex salts such as compounds described in U.S. Pat. No. 2,399,083 are preferably used as a gold sensitizer in the invention.

Of those compounds, particularly preferred are potassium chloroaurate, potassium aurithiocyanate, auric trichloride, sodium aurithiosulfate and 2-aurosulfobenzothiazolemetochloride. An amount of the gold sensitizer in the silver halide grain phase is in the range of $10^{-9}$ to $10^{-3}$ mol, preferably $10^{-8}$ to $10^{-4}$ mol, per 1 mol of the silver halide.

For increasing the gold sensitization, it is effective to use a thiocyanic acid salt in combination as described in T. H. James, "The Theory of the Photographic Process", 4th ed., p. 155, (Macmillan Co. Ltd., New York, 1977) or to use a substituted tetrathiourea compound in combination as described in Japanese Patent Publication No. 59(1984)-11892.

In the invention, sulfur sensitization is preferably used in combination with the gold sensitization.

Examples of sulfur sensitizers used for the sulfur sensitization include thiosulfates, thioureas, thiazoles, rhodanines and other compounds (see: U.S. Pat. Nos. 1,574,944, 2,410,689, 2,278,947, 2,728,668, 3,656,955, 4,030,928 and 4,067,740). Of these, preferred are thiosulfates, thioureas and rhodanines.

An amount of the sulfur sensitizer used herein is determined in accordance with grain size of the silver halide, temperature of the chemical sensitization, pAg value thereof, pH value thereof, etc. The amount of the sulfur sensitizer is in the range of generally $10^{-7}$ to $10^{-3}$ mol, preferably $5\times10^{-7}$ to $10^{-4}$, more preferably $5\times10^{-7}$ to $10^{-5}$ mol, based on 1 mol of the silver halide.

A temperature of the chemical sensitization is in the range of 30° to 90° C., a pAg value thereof is in the range of 5 to 10, and a pH value thereof is not less than 4.

In the invention, sensitization with other metals such as iridium, platinum or palladium (see: U.S. Pat. Nos. 2,448,060, 2,566,245 and 2,521,925) can be used in combination with the above-mentioned sensitization.

Next, main steps in the color image forming process of the invention are described in more detail.

Black and White Development Step

A black and white developing solution (processing solution) used in the invention contains a developing agent. Examples of the black and white developing agents include dihydroxybenzenes (e.g., hydroquinone and hydroquinone monosulfonate), 3-pyrazolidones (e.g., 1-phenyl-3-pyrazolidone and 1-phenyl-4-methyl-4-hydroxymethyl-3-pyrazolidone), aminophenols (e.g., N-methyl-p-aminophenol), ascorbic acid, and condensation heterocyclic compound of 1,2,3,4-tetrahydroquinoline ring and indolene ring (see: U.S. Pat. No. 4,067,872). The developing agents may be used in combination of two or more compounds. Preferred is a combination of dihydroxybenzenes and 3-pyrazolidones. The developing agent is used in an amount of $1\times10^{-5}$ to 1 mol per 1 liter of the black and white developing solution.

In addition to the developing agent, the black and white developing solution may contain preservatives (e.g., sulfite and bisulfite), solvents for silver halide, buffering agents (e.g., carbonate, boric acid, borate and alkanolamine), alkali agents (e.g., hydroxide and carbonate), dissolving aids (e.g., polyethylene glycols and their esters), pH adjusting agents (e.g., organic acid such as acetic acid), sensitizers (e.g., quaternary ammonium salt), development accelerators (e.g., thioether compound), surface active agents, defoaming agents, hardening agents, viscosity-imparting agents, antifogging agents, swelling inhibitors (e.g., sodium sulfate and potassium sulfate), chelating agents, etc.

Sulfite used as the preservative serves also as a solvent for silver halide. Examples of the solvents for silver halide other than sulfite include potassium thiocyanate, sodium thiocyanate, potassium sulfite, sodium sulfite, potassium bisulfite, sodium bisulfite, potassium thiosulfate, sodium thiosulfate and 2-methylimidazole. The solvent for silver halide is used in an amount of 0 to 0.02 mol based on 1 liter of the black and white developing solution, in the case of thiocyanic acid ion. Preferably, the amount of the solvent for silver halide is not more than 0.005 mol. The solvent for silver halide is used in the case of sulfurous acid ion in an amount of preferably 0 to 1 mol, more preferably 0 to 0.1 mol, based on 1 liter of the black and white developing solution.

A concentration of bromide ion in the black and white developing solution (processing solution) is preferably not more than $1\times10^{-3}$ mol/l, more preferably not more than $5\times10^{-4}$ mol/l. A concentration of sulfite ion in the black and white developing solution is preferably not more than $1\times10^{-1}$ mol/l, more preferably not more than $2\times10^{-2}$ mol/l. An amount of rhodanide ion contained in the black and white developing solution (processing solution) is preferably not more than $1\times10^{-2}$ mol/l, more preferably not more than $1\times10^{-3}$ mol/l. Further, the black and white developing solution (processing solution) contains chloride ion preferably in an amount of $5\times10^{-3}$ mol/l to $1\times10^{-1}$ mol/l, more preferably $5\times10^{-3}$ mol/l to $2\times10-2$ mol/l.

Examples of the antifogging agents include alkali metal salts of halogen (e.g., potassium bromide, sodium bromide and potassium iodide), nitrogen-containing heterocyclic compounds (e.g., benzotriazole, 6-nitrobenzimidazole, 5-nitroisoindazole, 5-methylbenzotriazole, 5-nitrobenzotriazole, 5-chlorobenzotriazole, 2-thiazolylbenzoimidazole, 2-thiazolylmethylbenzimidazole and hydroxyazaindolidine), mercapto-substituted heterocyclic compounds (e.g., 1-phenyl-5-mercaptotetrazole, 2-mercaptobenzimidazole and 2-mercaptobenzothiazole), and mercapto-substituted aromatic compounds (e.g., thiosalicylic acid). The antifogging agent may be added to the photographic material. In this case, the antifogging agent is eluted from the photographic material and is accumulated in the black and white developing solution during the black and white development. The antifogging agent is used in an amount of 0.001 to 0.05 mol per 1 liter of the black and white developing solution.

Examples of the chelating agents include aminopolycarboxylic acids (e.g., ethylenediaminetetraacetic acid, hydroxyethyliminodiacetic acid, propylenediaminetetraacetic acid, diethylenetriaminepentaacetic acid and triethylenetetraminehexaacetic acid), and phophonic acids (e.g., nitrilo-N,N,N-trimethylenephosphonic acid, ethylenediamine-N,N,N',N'-tetramethylenephosphonic acid and 1-hydroxyethylidene-1,1-diphosphonic acid). The chelating agents may be used in combination of two or more compounds. The chelating agent is used preferably in an amount of 0.1 to 20 g, more preferably 0.5 to 10 g, per 1 liter of the black and white developing solution.

A pH value of the black and white developing solution is preferably in the range of 8.5 to 11.5, and more preferably 9.0 to 10.5. An amount of a replenisher for the black and white developing solution is preferably in the range of 50 to 500 ml, more preferably 50 to 150 ml, based on 1 $m^2$ of the photographic material.

A period of time for the black and white development is preferably in the range of 10 to 120 seconds, and more preferably 10 to 45 seconds. A temperature therefor is preferably in the range of 30 to 50° C., and more preferably 35° to 45° C.

In the black and white development process, the step of the black and white development is followed by a step of washing.

The washing is preferably carried out using multistage counter current washing system with two or more tanks to reduce an amount of the replenisher. The amount of the replenisher may be reduced to as much as that of other processing bath (this case is called "rinsing bath"). The amount of the replenisher for the washing water is preferably in the range of 0.5 milliliter to 10 liters, more preferably 100 milliliter to 500 milliliter, based on 1 $m^2$ of the photographic material. If necessary, a processing solution for the rinsing bath may contain oxidizing agents, chelating agents, buffering agents and fungus-proof agents.

Reversal Step

In the color image forming process of the invention, a reversal step is carried out after the black and white development step. The reversal process includes chemical fogging treatment or reversal exposure treatment. The reversal exposure treatment is more preferred. In the chemical fogging treatment, a fogging agent such as tin ion type complex salt is used. By adding the fogging agent to a color developing solution which is described later, this reversal process and a color development process may be carried out in a single stage. In the case of reversal exposure, the whole surface of the photographic light-sensitive material is exposed at 100 lux for not shorter than 10 seconds.

Color Development Step

A color developing solution is generally an alkaline aqueous solution of aromatic primary amine type color developing agent. As the color developing agent, p-phenylenediamine type compounds are preferably used. Examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-methoxyethylanilie, and sulfates, hydrochlorides, phosphates, p-toluenesulfonates, tetraphenylborates and p-(t-octyl)benzenesulfonates of those compounds. The developing agent is used preferably in an amount of 1.0 to 15 g, more preferably 3.0 to 8.0 g, based on 1 liter of the color developing solution.

In addition to the color developing agent, the color developing solution may further contain buffering agents (e.g., carbonate, borate and phosphate of alkali metal), preservatives (e.g., hydroxylamine, diethylhydroxylamine, triethanolamine, catechol-3,5-disulfonate, sulfite and bisulfite), organic solvents (e.g., diethylene glycol and triethylene glycol), dye forming couplers, competing couplers (e.g., citrazinic acid, J acid and H acid), nucleating agents (e.g., sodium boron halide), developing aids (e.g., 1-phenyl-3-pyrazolidone), viscosity-imparting agents, development accelerators, antifogging agents, chelating agents, etc. Examples of the antifogging agents and the chelating agents are the same as those for the black and white developing solution.

Examples of the development accelerators include benzyl alcohol, pyridinium compounds (see: Japanese Patent Publication No. 44(1969)-9503, and U.S. Pat. Nos. 2,648,604 and 3,171,247), cationic dye (e.g., phenosafranine), nitrates (e.g., thallium nitrate and potassium nitrate), polyethylene glycol and its derivative (see: Japanese Patent Publication No. 44(1969)-9304, and U.S. Pat. Nos. 2,533,990, 2,531,832, 2,577,127 and 2,533,990), and polyethers and thioether compounds (see: U.S. Pat. No. 3,201,242).

A pH value of the color developing solution is preferably not less than 9, more preferably in the range of 9.5 to 12.0, most preferably 10.0 to 11.5. An amount of a replenisher for the color developing solution is preferably in the range of 25 ml to 500 ml, more preferably 50 ml to 150 ml, based on 1 $m^2$ of the photographic material.

A temperature for the color development is preferably in the range of 30° to 50° C., more preferably 31° to 45° C.

A concentration of bromide ion in the color developing solution (processing solution) is preferably not more than $1\times10^{-3}$ mol/l, and more preferably not more than $5\times10^{-4}$ mol/l. A concentration of sulfurous acid ion in the color developing solution is preferably not more than $1\times10^{-2}$ mol/l, more preferably not more than $5\times10^{-2}$ mol/l. Further, the color developing solution (processing solution) preferably contains chloride ion in an amount of $5\times10^{-3}$ to $1\times10^{-1}$ mol/l.

Desilvering Step

The desilvering step includes steps of compensating, washing, bleaching, fixing, bleach-fixing, and stabilizing substituted for washing. Replenishers corresponding to each baths of those steps can be individually replenished. In the case where the bleach-fixing is carried out after the bleaching, it is possible that an overflowed solution of the bleach bath is introduced into the bleach-fix bath and that only a fixing solution is replenished into the bleach-fix bath.

Typical examples of the bleaching agents used for the bleaching step or the bleach-fixing step are aminopolycarboxylic acid iron(III) complex salts. Examples of preferred bleaching agents include ethylenediaminetetraacetic acid, disodium ethylenediaminetetraacetate, diammonium ethylenediaminetetraacetate, diethylenetriaminepentaacetic acid, cyclohexanediaminetetraacetic acid, disodium cyclohexanediaminetetraacetate, iminodiacetic acid and 1,3-diaminopropanetetraacetic acid.

As for the aminopolycarboxylic acid iron(III) complex salt, iron(III) salt and aminopolycarboxylic acid may be added to the processing solution to form iron(III) complex salt in the processing solution. The aminopolycarboxylic acids may be used in combination of two or more kinds. Further, the aminopolycarboxylic acid may be used in an excess amount (more than the amount required for forming iron(III) complex salt). In addition to the iron(III) complex salt, complex salts of other metals than iron such as cobalt and copper may also be added to the bleaching solution or the bleach-fixing solution.

An amount of the bleaching agent used for the bleaching solution is preferably in the range of 0.1 to 1 mol, more preferably 0.2 to 0.5 mol, based on 1 liter of the bleaching solution. A pH value of the bleaching solution is preferably in the range of 4.0 to 8.0, more preferably 5.0 to 6.5.

An amount of the bleaching agent used for the bleach-fixing solution is preferably in the range of 0.05 to 0.5 mol, more preferably 0.1 to 0.3 mol, based on 1 liter of the bleach-fixing solution. A pH value of the bleach-fixing solution is preferably in the range of 5 to 8, and more preferably 6 to 7.5.

A bleaching accelerator can be added to the bleaching bath, the bleach-fix bath or the compensating bath. Examples of the bleaching accelerators include mercapto compounds (see: Japanese Patent Provisional Publication No. 53(1978)-141623, U.S. Pat. No. 3,893,858 and U.K. Patent No. 1,138,842), compounds having disulfide bond (see: Japanese Patent Provisional Publication No. 53(1978)-95630), thiazolidine derivatives (see: Japanese Patent Publication No. 53(1978)-9854), isothiourea derivatives (see: Japanese Patent Provisional Publication No. 53(1978)-94927), thiourea derivatives (see: Japanese Patent Publications No. 45(1969)-8506 and No. 49(1974)-26586), thioamide compounds (see: Japanese Patent Provisional Publication No. 49(1974)-42349), dithiocarbamates (see: Japanese Patent Provisional Publication No. 55(1980)-26506), and alkylmercapto compounds (e.g., trithioglycerol, $\alpha,\alpha'$-thiodipropionic acid and $\delta$-mercapto burytic acid). The alkylmercapto compounds may have substituent groups such as hydroxyl group, carboxyl group, sulfonic acid group and amino group. These groups may further have substituent groups such as alkyl group and acetoxyalkyl group.

An amount of the bleaching accelerator used herein is determined in consideration of kind of the photographic material, processing temperature and processing period. When a mercapto compound, a compound having disulfide bond, a thiazolidine derivative or an isothiourea derivative is used as the bleaching accelerator, the amount thereof is preferably in the range of $10^{-5}$ to $10^{-1}$ mol, and more preferably $10^{-4}$ to $5\times10^{-2}$ mol, based on 1 liter of the processing solution.

To the bleaching solution may be added rehalogenating agents, inorganic acids, organic acids or salts of those acids, those acids and salts having pH buffering ability, in addition to the bleaching agents and the bleaching accelerators. Examples of the rehalogenating agents include bromides (e.g., potassium bromide, sodium bromide and ammonium bromide) and chlorides (e.g., potassium chloride, sodium chloride and ammonium chloride). Examples of the acids or salts having pH buffering ability include nitrates (e.g., sodium nitrate and ammonium nitrate), boric acid, borax, sodium metaborate, acetic acid, sodium acetate, sodium carbonate, potassium carbonate, phosphorous acid, phosphoric acid, sodium phosphate, citric acid, sodium citrate and tartaric acid.

Examples of fixing agents used for the fixing and bleach-fixing include thiosulfates (e.g., sodium thiosulfate and ammonium thiosulfate) thiocyanates (e.g., sodium thiocyanate, ammonium thiocyanate and potassium thiocyanate), thiourea and thioether.

An amount of the fixing agent used for the bleach-fixing solution is preferably in the range of 0.3 to 3 mol, more preferably 0.5 to 2 mol, based on 1 liter of the bleach-fixing solution.

An amount of the fixing agent used for the fixing solution is preferably in the range of 0.5 to 4 mol, more preferably 1 to 3 mol, based on 1 liter of the fixing solution. A pH value of the fixing solution is preferably in the range of 6 to 10, more preferably 7 to 9.

The fixing solution or the bleach-fixing solution may further contain various known additives such as sulfites, bisulfites, buffering agents, chelating agents and sulfinic acids. Also employable for the fixing solution or the bleach-fixing solution are ammonium halides (e.g., ammonium bromide), alkali metal salts of halogen (e.g., sodium bromide and sodium iodide). In the case where the fixing solution or the bleach-fixing solution is diluted with the overflowed solution of the bleaching bath, it is preferred to make concentration of each component in the fixing solution or the bleach-fixing solution relatively high. When dilution of those solutions with the overflowed solution is taken into account, an amount of the discharged solution can be reduced and a burden for recovery of the discharged solution can be removed.

An amount of a replenisher for each of the bleaching solution, the fixing solution and the bleach-fixing solution is preferably in the range of 30 ml to 500 ml, more preferably 50 ml to 150 ml, based on 1 $m^2$ of the photographic material.

In the desilvering process, washing or stabilization substituted for washing is finally carried out.

The washing water used for the washing may contain known additives if necessary. Examples of the additives include chelating agents (e.g., inorganic phosphoric acid, aminopolycarboxylic acid and organic phosphoric acid), fungus-proof agents, mildew-proof agents, hardening agents and surface active agents. The stabilization substituted for washing may be carried out using two or more baths. Further, multi-stage counter current washing system (e.g., 2–9 stages) may be used to save the washing water.

The stabilizing solution used for the stabilization substituted for washing serves to stabilize a dye image provided by the light-sensitive material. Examples of the stabilizing solutions include solutions with buffering ability having a pH value of 3 to 6 and solutions containing aldehyde (e.g., formaldehyde). The stabilizing solution may further contain chelating agents, fungus-proof agents, mildew-proof agents, hardening agents and surface active agents depending on necessity. The stabilization substituted for washing may be carried out using two or more baths. Further, multi-stage counter current washing system (e.g., 2–9 stages) may be used to save the stabilizing solution.

If desired, the processing bath for the above-mentioned each step may be equipped with heater, temperature sensor, liquid surface sensor, cycling pump, filter, floating lid, squeegee, nitrogen-stirring device, air-stirring device, etc.

The color photographic material used in the invention is described below.

The color photographic material has a silver halide emulsion layer containing an yellow coupler, a silver halide emulsion layer containing a magenta coupler and a silver halide emulsion layer containing a cyan coupler on a support. Light-sensitive wavelengths of the silver halide emulsion layers are different from each other. Each of the emulsion layers generally has a sensitivity to a visible light, concretely, to any one of a blue light, a green light and a red light. In the ordinary color photographic material, the blue sensitive silver halide emulsion layer contains an yellow coupler, the green sensitive silver halide emulsion layer contains a magenta coupler, and the red sensitive silver halide emulsion layer contains a cyan coupler. The silver halide emulsion layers are generally arranged in the order of a red sensitive layer, a green sensitive layer and a blue sensitive layer from the support side.

The emulsion layers may have a sensitivity within a region other than the visible region. Further, other combination of sensitivity and coupler in the emulsion layer than the above-mentioned one or other arrangement of the light-sensitive layers than the above-mentioned one is also available. Each of the emulsion layers may has a two-layer structure consisting of a high sensitive emulsion layer and a low sensitive emulsion layer. In the ordinary color photographic material, layers having various functions (e.g., antihalation layer, intermediate layer, ultraviolet absorbing layer and protective layer) are provided in addition to the silver halide emulsion layer.

The coating amount of the silver halide emulsion is preferably in the range of 0.1 to 1.5 g/$m^2$, more preferably 0.1 to 1.0 g/$m^2$, in terms of silver.

The silver halide emulsion is generally subjected to physical ripening, chemical ripening and spectral sensitization in the preparation thereof. A process for preparing the silver halide emulsion is described in "I. Emulsion preparation and types", Research Disclosure, No. 17643, pp. 22–23 (December, 1978).

The silver halide emulsion can be prepared by a controlled double jet method or a method of using a solvent for silver halide during the grain formation stage.

In the controlled double jet method, a soluble silver salt is reacted with a soluble halogen salt by a simultaneous mixing method and a pAg value of the liquid phase in which silver halide is formed is kept at a constant value. By keeping the pAg value, grains of desired regular crystals can be obtained and a silver halide emulsion having a uniform grain size distribution (monodispersed emulsion) can be prepared.

Examples of the solvents for silver halide include ammonia, potassium rhodanide, ammonium rhodanide, thioether compounds (see: U.S. Pat. Nos. 3,271,157, 3,574,628, 3,704,130, 4,297,439 and 4,276,374), substituted tetrathiourea compounds (see: Japanese Patent Provisional Publications No. 53(1978)-82408 and No. 55(1989)-77737), thion compounds (see: Japanese Patent Provisional Publications No. 53(1978)-144319, No. 53(1978)-82408 and No. 55(1989)-77737), and amine compounds (see: Japanese Patent Provisional Publication No. 54(1979)-100717).

The solvent for silver halide is used preferably in an amount of $10^{-5}$ mol to $2.5\times10^{-2}$ mol per 1 mol of the silver halide. It is preferred to add the solvent for silver halide during sedimentation of the silver halide grains or physical ripening in the preparation of the silver halide emulsion.

A heavy metal can be used during the formation of silver halide grains (preferably silver halide grains in the low concentration side) or during the physical ripening to improve photographic properties of the color photographic material. Examples of the heavy metals include rhodium, cadmium, lead, thallium, iridium, copper, iron and zinc. Of these, preferred are rhodium, cadmium and thallium. The heavy metal may be added in the form of a metal salt. Two or more kinds of heavy metals may be used in combination. The heavy metal is used preferably in an amount of $10^{-10}$ to $10^{-2}$ mol, more preferably $10^{-2}$ to $10^{-3}$ mol, based on the amount of the silver halide.

A phenol compound may be added to the silver halide emulsion layer to improve photographic properties of the color photographic material. A hydroquinone compound is particularly preferred as the phenol compound. The hydroquinone compound is described in Japanese Patent Provisional Publications No. 55(1980)-43521, No. 56(1981)-109344, No. 57(1982)-22237 and No. 60(1985)-172040, and U.S. Pat. No. 2,701,197.

The phenol compound can be added in the form of an aqueous solution of alkali to the photographic material. Further, the phenol compound may be added to the photographic material in the form of an emulsion obtained by dissolving it in a high boiling oil. The phenol compound is used preferably in an amount of $10^{-4}$ to 1 g/m$^2$.

The photographic material used in the invention contains an yellow coupler, a magenta coupler and a cyan coupler to form a color image. With respect to those couplers, a variety of compounds have been already known. There in no specific limitation on the kinds of couplers employable in the invention.

Preferred yellow couplers are pivaloyl type and pyrozoloazole type compounds. The yellow couplers are described in Japanese Patent Publication No. 58(1983)-10739, U.S. Pat. Nos. 3,933,501, 3,973,968, 4,022,620, 4,248,961, 4,314,023, 4,326,024, 4,401,752 and 4,511,649, U.K. Patents No. 1,425,020 and No. 1,476,760, and European Patent No. 249473A.

Preferred magenta couplers are 5-pyrazolone type and pyrazoloazole type compounds. The magenta couplers are described in Japanese Patent Provisional Publications No. 55(1980)-118034, No. 60(1985)-33552, No. 60(1985) -35730, No. 60(1985)-43659, No. 60(1985)-185951 and No. 61(1986)-72233, U.S. Pat. Nos. 3,061,432, 3,725,067, 4,310,619, 4, 351,897, 4,500,630, 4,540,654 and 4,556,630, European Patent No. 73636, International Patent No. WO88/04795, and *Research Disclosure* No. 24220 (June, 1984) and ibid. No.24230 (June, 1984).

Preferred cyan couplers are phenol type and naphthol type compounds. The cyan couplers are described in Japanese Patent Provisional Publication No. 61(1986)-42658, U.S. Pat. Nos. 2,369,929, 2,772,162, 2,801,171, 2,895,826, 3,446,622, 3,758,308, 3,772,002, 4,052,212, 4,146,396, 4,228,233, 4,254,212, 4,296,199, 4,296,200, 4,327,173, 4,333,999, 4,334,011, 4,427,767, 4,451,559, 4,690,889 and 4,775,616, West German Patent Publication No. 3,329,729, and European Patents No. 121365A and No. 249453A.

Other couplers than those described above can also be added to the photographic material. Examples thereof include a colored coupler to compensate incidental absorption of a formed dye (see: Japanese Patent Publication No. 57(1982)-39313, U.S. Pat. Nos. 4,004,909, 4,138,258 and 4,163,670, U.K. Patent No. 1,146,368, and *Research Disclosure* No. 17643, VII-G), a coupler whose fluorescent dye released in coupling stage compensates incidental absorption of a formed dye (see: U.S. Pat. No. 4,774,181), a coupler having as an eliminating group a dye precursor which reacts with a developing agent to form a dye (see: U.S. Pat. No. 4,777,120), a coupler which gives a color developing dye exhibiting a proper diffusion (see: U.S. Pat. No. 4,366,237, U.K. Patent No. 2,125,570, West German Patent Publication No. 3,234,533 and European Patent No. 96,570), a polymerized dye-forming coupler (see: U.S. Pat. Nos. 3,451,820, 4,080,211, 4,367,282, 4,409,320 and 4,576,910, and U.K. Patent No. 2,102,173), a DIR coupler which releases a development inhibitor in accordance with coupling (see: Japanese Patent Provisional Publications No. 57(1982)-151944, No. 57(1982)-154234, No. 60(1985)-184248, No. 63(1988)-37346 and No. 63(1988)-37350, U.S. Pat. Nos. 4,248,962 and 4,782,012, and *Research Disclosure* No. 17643, VII-F), a coupler which imagewise releases a nucleating agent or a development accelerator in the developing process (see: Japanese Patent Provisional Publications No. 59(1984)-157638 and No. 59(1984)-170840, and U.K. Patents No. 2,097,140 and No. 2,131,188), a competing coupler (see: U.S. Pat. No. 4,130,427), a polyvalent coupler (see: U.S. Pat. Nos. 4,283,472, 4,338,393 and 4,310,618), a DIR redox compound-releasing coupler, a DIR coupler-releasing coupler, a DIR coupler-releasing compound or a DIR redox-releasing redox compound (see: Japanese Patent Provisional Publications No. 60(1985)-185950 and No. 62(1987)-24252), a coupler which releases a dye having restoration to original color after elimination (see: European Patents No. 173302A and No. 313308A), a bleaching accelerator-releasing coupler (see: Japanese Patent Provisional Publication No. 61(1986)-201247, and *Research Disclosure* No. 11449 and ibid. No. 24241), a coupler which releases ligand (see: U.S. Pat. No. 4,553,477), and a coupler which releases a leuco dye (see: Japanese Patent Provisional Publication No. 63(1988)-75747).

The coupler used in the invention is preferably incorporated into the photosensitive material using a high-boiling solvent (preferably having a boiling point of not lower than 175° C.). In concrete, the coupler is dissolved in a high-boiling solvent and the resulting solution is emulsified in an aqueous solution of a silver halide emulsion or the like.

Examples of the high-boiling solvents include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate and bis(1,1-diethylpropyl)phthalate), esters of phosphoric acids or phosphonic acids (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphonate), benzoic esters (e.g., 2-ethylhexyl benzoate, dodecyl benzoate and 2-ethylhexyl-p-hydroxybenzoate), amides (e.g., N,N-diethyldodecanamide, N,N-diethyllaurylamide and N-tetradecylpyrrolidone), alcohols (e.g., isostearyl alcohol), phenols (e.g., 2,4-di-tert-amylphenol), aliphatic carboxylic esters (e.g., bis(2-ethylhexyl)sebacate, dioctyl azelate, glycerol tributyrate, isostearyl lactate and trioctyl citrate), aniline derivatives (e.g., N,N-dibutyl-2-butoxyl-5-tert-octylaniline), and hydrocarbons (e.g., paraffin, dodecyl benzene, diisopropyl naphthalene).

As assisting solvents for the high-boiling solvents, there can be used organic solvents having a boiling point of not lower than 30° C., preferably in the range of 50° C. to approx. 160° C. Examples of the assisting solvents include ethyl acetate, butyl acetate, ethyl propionate, methyl ethyl ketone, cyclohexanone, 2-ethoxyethyl acetate and dimethylformamide.

Additives available for the photographic material are described in *Research Disclosure*, No. 17643, and ibid. No. 18716. The relevant parts in the literature are also set forth in the following table.

TABLE

| Additives | R.D. No. 17643 | R.D. No. 18716 |
|---|---|---|
| Chemical Sensitizer | p. 23 | p. 648, right column |
| Sensitivity Promoter | | p. 648, right column |
| Spectral Sensitizer Color Sensitizer | pp. 23–24 | pp. 648, right column-649, right column |
| Brightening Agent | p. 24 | |
| Antifoggant and Stabilizer | pp. 24–25 | p. 649, right column |
| Absorbent, Filter Dye, UV Absorbent | pp. 25–26 | pp. 649, right, column-650, right column |
| Stain Inhibitor | p. 25, right column | p. 650, left-column-right column |
| Dye Image Stabilizer | p. 25 | |
| Hardening Agent | p. 26 | p. 651, left column |
| Binder | p. 26 | p. 651, left column |
| Plasticizer, Lubricant | p. 27 | p. 650, right column |
| Coating Aid, Surface Active Agent | pp. 26–27 | p. 650, right column |
| Antistatic Agent | p. 27 | p. 650, right column |

In order to prevent deterioration of photographic properties of the photographic material caused by formaldehyde gas, compounds which react with formaldehyde to fix it may be added to the photographic material. Such compounds Hydroquinones which release a development inhibiting compound (see: Japanese Patent Provisional Publication No. 64(1989)-546 and U.S. Pat. Nos. 3,379,529 and 3,639,417) or naphtohquinones which release a development inhibiting compound (see: *Research Disclosure*, No. 18264, June, 1979) may be also added to the photographic material.

Further, rot-proof agents or fungus-proof agents can be also added to the photographic material. Examples of the rot-proof agents and the fungus-proof agents include 1,2-benzisothiazoline-3-on, n-butyl-p-hydroxybenzoate, phenol, 4-chloro-3,5-dimethylphenol, 2-phenoxyethanol and 2-(4-thiazolyl)benzimidazole. The rot-proof agents and the fungus-proof agents are described in Japanese Patent Provisional Publications No. 63(1988)-257747, No. 62(1987)-272248 and No. 1(1989)-80941.

There is no specific limitation on the support used for the photographic material. The support is described in *Research Disclosure* No. 17643, p. 28, and ibid. No. 18716, pp. 647 (right column)–648 (left column).

In the color photographic material used the invention, the total film thickness of all of the hydrophilic colloidal layers on the side having the emulsion layer is preferably not more than 28 μm, more preferably not more than 20 μm, most preferably not more than 12 μm. Further, the film swelling speed ($T_{\frac{1}{2}}$) is preferably not more than 30 sec, more preferably not more more 20 sec. The film swelling speed is defined as a time required to reach a half of saturated film thickness of a film, in the case where the saturated film thickness is 90% of a maximum swelling film thickness given when the film is treated with a color developing solution at 30° C. for 3 minutes and 15 seconds. The film thickness can be measured using a swellometer. The film swelling speed is described in A Green et al., "Photographic Science and Engineering", vol. 19, No. 2, pp. 124–129.

The film swelling speed can be adjusted by adding a hardening agent to gelatin used as a binder or varying conditions on the elapsed time after a coating process. The swelling degree is preferably between 150 and 400%.

The method of the present invention can be favorably used for the formation of a positive color image in which a color reversal film for slide or television, or a color reversal paper is used.

EXAMPLE 1

To a 3% aqueous solution of lime treated gelatin were added 3.3 g of sodium chloride and 3.2 ml of 1% aqueous solution of N,N'-dimethylimidazoline-2-thion. To the resulting solution were further added an aqueous solution containing 0.2 mol of silver nitrate and an aqueous solution containing 0.2 mol of sodium chloride at 52° C. under vigorous stirring. Subsequently, to the resulting mixture were added an aqueous solution containing 0.775 mol of silver nitrate and an aqueous solution containing 0.775 mol of sodium chloride and 2.0 mg of potassium hexacyanoferrate(III) trihydrate at 52° C. under vigorous stirring. At an interval of 1 minute after addition of the silver nitrate aqueous solution and the sodium chloride aqueous solution was completed, the red sensitizing dyes 1, 2 and 3 were added to the mixture each in an amount of 95.6 mg.

The resulting mixture was kept at 52° C. for 15 minutes, and then to the mixture were further added an aqueous solution containing 0.025 mol of silver nitrate and an aqueous solution containing 0.02 mol of potassium bromide, 1.0 mg of potassium hexachloroiridate(IV) and 0.005 mol of sodium chloride at 40° C. under vigorous stirring. Then, the mixture was subjected to desilvering and washing. To the mixture were further added 90.09 of lime treated gelatin and triethylthiourea to most suitably perform chemical sensitization so as to obtain a surface latent image type emulsion. Thus obtained silver chlorobromide (silver bromide: 2 mole %) emulsion was referred to as EM-1.

The above procedure for preparing the emulsion EM-1 was repeated except for using 58.0 mg of the green sensitizing dye 1 instead of the red sensitizing dyes 1, 2 and 3, to prepare an emulsion EM-2.

Further, the above procedure for preparing the emulsion EM-1 was repeated except for using 168.3 mg of the blue sensitizing dye 1 instead of the red sensitizing dyes 1, 2 and 3, to prepare an emulsion EM-3.

Next, to a 3% aqueous solution of lime treated gelatin were added 3.3 g of sodium chloride and 3.2 ml of a 1% aqueous solution of N,N'-dimethylimidazoline-2-thion. To the resulting solution were further added an aqueous solution containing 0.2 mol of silver nitrate and an aqueous solution containing 0.2 mol of sodium chloride at 52° C. under vigorous stirring. Subsequently, to the resulting mixture were further added an aqueous solution containing 0.775 mol of silver nitrate and an aqueous solution containing 0.768 mol of sodium chloride, 0.007 mol of potassium iodide and 2.0 mg of potassium hexacyanoferrate(III) trihydrate at 52° C. under vigorous stirring. At an interval of 1 minute after addition of the silver nitrate aqueous solution and the sodium chloride aqueous solution was completed, the red sensitizing dyes 1, 2 and 3 were added to the mixture each in an amount of 95.6 mg.

The resulting mixture was kept at 52° C. for 15 minutes, and then to the mixture were added an aqueous solution containing 0.025 mol of silver nitrate and an aqueous solution containing 0.02 mol of potassium bromide, 0.003 mol of potassium iodide, 1.0 mg potassium hexachloroiridate(IV) and 0.005 mol of sodium chloride at 40° C. under vigorous stirring. Then, the mixture was subjected to desilvering and washing. To the mixture were further added 90.0 g of lime treated gelatin and then triethylthiourea to most suitably perform chemical sensitization so as to obtain a surface latent image type emulsion. Thus obtained silver chloroiodobromide (silver bromide: 2 mole %), (silver iodide: 1 mole %) emulsion was referred to as EM-4.

The above procedure for preparing the emulsion EM-4 was repeated except for using 58.0 mg of the green sensitizing dye 1 or 168.3 g of the blue sensitizing dye instead of the red sensitizing dyes 1, 2 and 3, to prepare an emulsion EM-5 or EM-6.

(Red sensitizing dye 1)

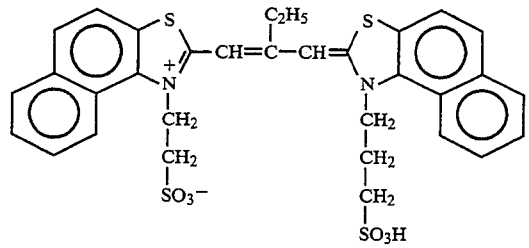

(Red sensitizing dye 2)

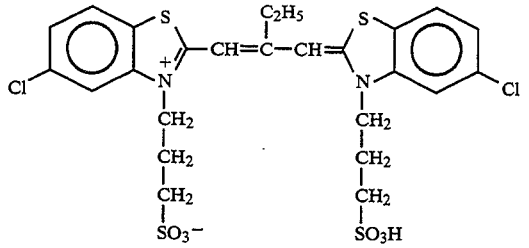

(Red sensitizing dye 3)

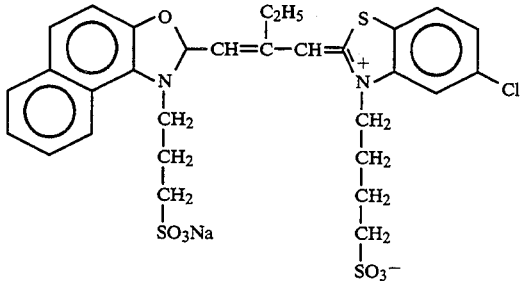

(Green sensitizing dye 1)

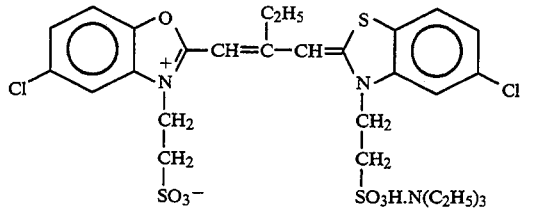

(Blue sensitizing dye 1)

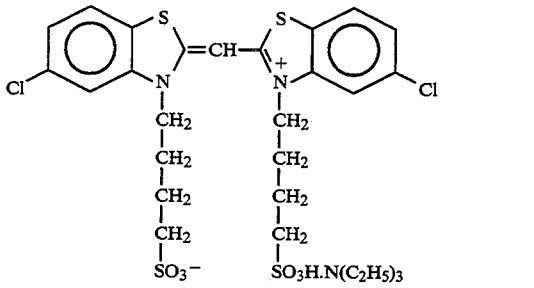

Grains contained in six kinds of the silver halide emulsions EM-1 to EM-6 prepared as above were measured on grain shape, grain size and grain size distribution from their electron micrographs. The silver halide grains containted in each of the emulsions EM-1 to EM-6 were in the form of cube. The grain size was expressed by a mean diameter of a circle equivalent to a projected area of the grain, and the grain size distribution is expressed by a value obtained by dividing a standard deviation of the grain size by a mean grain size.

Then, a halogen composition of the grain in the emulsion was determined by measuring X-ray diffraction from the silver halide crystal. A monochromatic CuKα ray was used as a ray source, and a diffraction angle of a diffraction ray from the plane (200) was measured in detail. A diffraction ray from a crystal having a homogeneous halogen composition gives a single peak, while a diffraction ray from a crystal having a heterogeneous halogen composition gives plural peaks corresponding to the composition. From the measured diffraction angle of peak, a lattice constant was calculated to determine the halogen composition of the silver halide constituting the crystal. The results are set forth in Table 1.

TABLE 1

| Emulsion | Shape | Grain Size (μm) | Size Distribution | Main Peak (%) | Sub Peak (%) |
|---|---|---|---|---|---|
| EM-1 | Cube | 0.51 | (0.08) | Cl 100 | Cl 83–90 |
| EM-2 | Cube | 0.50 | (0.08) | Cl 100 | Cl 83–90 |
| EM-3 | Cube | 0.51 | (0.07) | Cl 100 | Cl 83–90 |
| EM-4 | Cube | 0.40 | (0.09) | Cl 99 | Cl 80–90 |
| EM-5 | Cube | 0.40 | (0.09) | Cl 99 | Cl 80–90 |
| EM-6 | Cube | 0.49 | (0.09) | Cl 99 | Cl 80–90 |

EXAMPLE 2

The procedure for preparing the emulsion EM-1 in Example 1 was repeated except for varying the temperature for the formation of the silver halide grains and the time required for adding the silver nitrate aqueous solution and the alkali halide aqueous solution, to prepare emulsions EM-11, EM-12 and EM-13 having grain sizes of 0.3 μm, 0.5 μm and 0.8 μm, respectively. The emulsions EM-11, EM-12 and EM-13 had grain size distributions of 0.07, 0.08 and 0.09, respectively.

In the similar manner, from the emulsion EM-2 were prepared emulsions EM-21, EM-22 and EM-23 having grain sizes of 0.3 μm, 0.45 μm and 0.8 μm, respectively. The emulsions EM-21, EM-22 and EM-23 had grain size distributions of 0.07, 0.08 and 0.09, respectively.

Further, in the similar manner, from the emulsion EM-3 were prepared emulsions EM-31, EM-32 and EM-33 having grain sizes of 0.4 μm, 0.55 μm and 1.1 μm, respectively. The emulsions EM-31, EM-32 and EM-33 had grain size distributions of 0.06, 0.07 and 0.11, respectively.

A paper was laminated with polyethylene on both sides to prepare a paper support (thickness: 200 μm). On the surface of the paper support, the following first to twelfth layers were provided to prepare a color photographic material. Polyethylene on the first layer side included 15% by weight of anatase-type titanium oxide as a white pigment and an extremely small amount of ultramarine as a blue dye. Chromaticities of the support surface were determined to be 89.0, −0.18 and −0.73 in L*, a* and b* system, respectively.

Composition of Layers

Components and their amounts (g/m²) in each layer are set forth below. The values for the silver halide emulsions mean the coating amount in terms of silver.

| | |
|---|---|
| The first layer (Gelatin layer) | |
| Gelatin | 0.30 |

-continued

| | |
|---|---|
| The second layer (Antihalation layer) | |
| Black colloidal silver | 0.07 |
| Gelatin | 0.50 |
| The third layer (Low red sensitive layer) | |
| EM-11 | 0.06 |
| EM-12 | 0.07 |
| Gelatin | 1.00 |
| Cyan coupler 1 | 0.14 |
| Cyan coupler 2 | 0.07 |
| Discoloration inhibitor 1 | 0.03 |
| Discoloration inhibitor 2 | 0.03 |
| Discoloration inhibitor 3 | 0.03 |
| Dispersion medium (for coupler) | 0.03 |
| Di(2-ethylhexyl)phthalate (solvent for coupler) | 0.02 |
| Trinonyl phosphate (solvent for coupler) | 0.02 |
| Di(3-methylhexyl)phthalate (solvent for coupler) | 0.02 |
| Development accelerator | 0.05 |
| The fourth layer (High red sensitive layer) | |
| EM-13 | 0.15 |
| Gelatin | 1.00 |
| Cyan coupler 1 | 0.20 |
| Cyan coupler 2 | 0.10 |
| Discoloration inhibitor 1 | 0.05 |
| Discoloration inhibitor 2 | 0.05 |
| Discoloration inhibitor 3 | 0.05 |
| Dispersion medium (for coupler) | 0.03 |
| Di(2-ethylhexyl)phthalate (solvent for coupler) | 0.033 |
| Trinonyl phosphate (solvent for coupler) | 0.033 |
| Di(3-methylhexyl)phthalate (solvent for coupler) | 0.033 |
| Development accelerator | 0.05 |
| The fifth layer (Intermediate layer) | |
| Magenta colloidal silver | 0.02 |
| Gelatin | 1.00 |
| Color stain inhibitor 1 | 0.08 |
| Tricresyl phosphate (solvent for color stain inhibitor) | 0.08 |
| Dibutyl phthalate (solvent for color stain inhibitor) | 0.08 |
| Polyethyl acrylate late (molecular weight: 10,000–100,000) | 0.10 |
| The sixth layer (Low green sensitive layer) | |
| EM-21 | 0.03 |
| EM-22 | 0.05 |
| Gelatin | 0.80 |
| Magenta coupler 1 | 0.05 |
| Magenta coupler 2 | 0.05 |
| Discoloration inhibitor 4 | 0.10 |
| Stain inhibitor 1 | 0.05 |
| Stain inhibitor 2 | 0.05 |
| Stain inhibitor 3 | 0.001 |
| Stain inhibitor 4 | 0.01 |
| Dispersion medium (for coupler) | 0.05 |
| Tricresyl phosphate (solvent for coupler) | 0.075 |
| Trioctyl phosphate (solvent for coupler) | 0.075 |
| The seventh layer (High green sensitive layer) | |
| EM-23 | 0.10 |
| Gelatin | 0.80 |
| Magenta coupler 1 | 0.05 |
| Magenta coupler 1 | 0.05 |
| Discoloration inhibitor 4 | 0.10 |
| Stain inhibitor 3 | 0.001 |
| Stain inhibitor 4 | 0.01 |
| Dispersion medium (for coupler) | 0.05 |
| Tricresyl phosphate (solvent for coupler) | 0.075 |
| Trioctyl phosphate (solvent for coupler) | 0.075 |
| The eighth layer (Yellow filter layer) | |
| Yellow colloidal silver | 0.03 |
| Gelatin | 1.00 |
| Color stain inhibitor 1 | 0.06 |
| Tricresyl phosphate (solvent for color stain inhibitor) | 0.075 |
| Dibutyl phthalate (solvent for color stain inhibitor) | 0.075 |
| Polyethyl acrylate latex (molecular weight: 10,000–100,000) | 0.10 |
| The ninth layer (Low blue sensitive layer) | |
| EM-31 | 0.07 |
| EM-32 | 0.10 |
| Gelatin | 0.50 |
| Yellow coupler 1 | 0.10 |
| Yellow coupler 2 | 0.10 |
| Discoloration inhibitor 5 | 0.10 |

-continued

| | |
|---|---|
| Stain inhibitor 3 | 0.001 |
| Dispersion medium (for coupler) | 0.05 |
| Trinonyl phosphate (solvent for coupler) | 0.05 |
| The tenth (High blue sensitive layer) | |
| EM-33 | 0.25 |
| Gelatin | 1.00 |
| Yellow coupler 1 | 0.20 |
| Yellow coupler 2 | 0.20 |
| Discoloration inhibitor 5 | 0.10 |
| Stain inhibitor 3 | 0.002 |
| Dispersion medium (for coupler) | 0.15 |
| Trinonyl phosphate (solvent for coupler) | 0.10 |
| The eleventh layer (Ultraviolet absorbing layer) | |
| Gelatin | 1.50 |
| Ultraviolet absorbent 1 | 0.50 |
| Ultraviolet absorbent 1 | 0.50 |
| Color stain inhibitor 2 | 0.04 |
| Dispersion medium (for ultraviolet absorbent) | 0.15 |
| Di(2-ethylhexyl)phthalate (solvent for ultraviolet absorbent) | 0.075 |
| Trinonyl phosphate (solvent for ultraviolet absorbent) | 0.075 |
| Dye 1 (for anti-irradiation) | 0.01 |
| Dye 2 (for anti-irradiation) | 0.01 |
| Dye 3 (for anti-irradiation) | 0.01 |
| Dye 4 (for anti-irradiation) | 0.01 |

-continued

| | |
|---|---|
| The twelfth layer (Protective layer) | |
| Gelatin | 0.90 |
| 1,2-bis(vinylsulfonylacetamide)ethane (gelatin hardening agent) | 0.085 |
| 4.6-dichloro-2-hydroxy-1,3,5-triazine sodium salt (gelatin hardening agent) | 0.085 |
| Non-light-sensitive silver halide (silver chlorobromide, silver bromide: 3 mole %, mean grain size: 0.2 μm) | 0.02 |
| Modified POVAL | 0.05 |

Further, emulsifying dispersing agents of Alkanol XC (trade name of Du Pont) and sodium alkylbenzene sulfonate, coating aids of succinic acid ester and Magefac F120 (trade name of Dainippon Ink & Chemicals Inc.), and rot-proof agents 1, 2 and 3 were also added to each layer. The following stabilizers 1 and 2 were added to each of the layers containing silver halide or colloidal silver.

Thus prepared photographic material was referred to as a sample S-20.

Followings are compounds employed for the preparation of the photographic material.

(Cyan coupler 1)

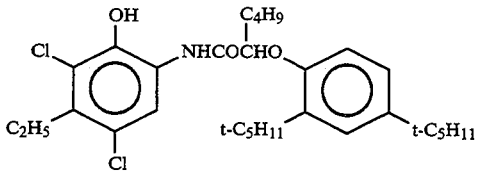

(Cyan coupler 2)

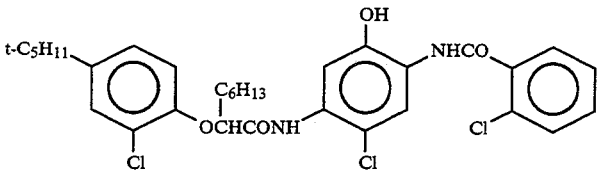

(Magenta coupler 1)

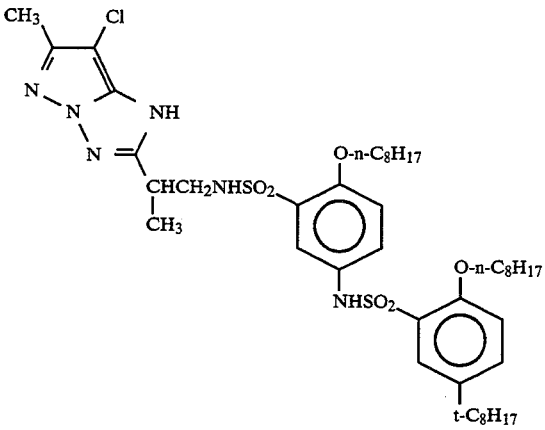

(Magenta coupler 2)

-continued
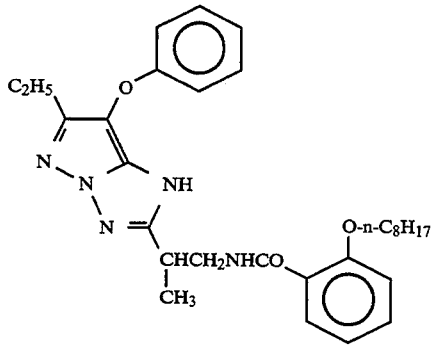
(Yellow coupler 1)
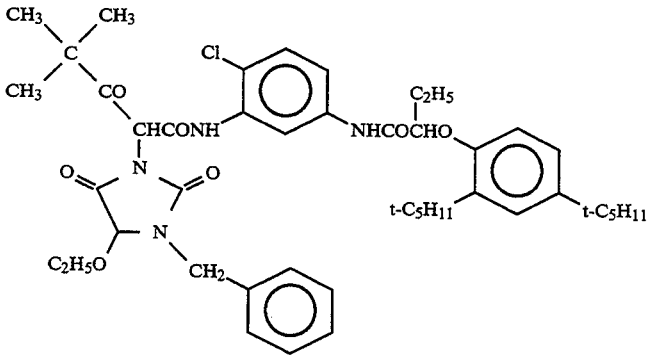
(Yellow coupler 2)
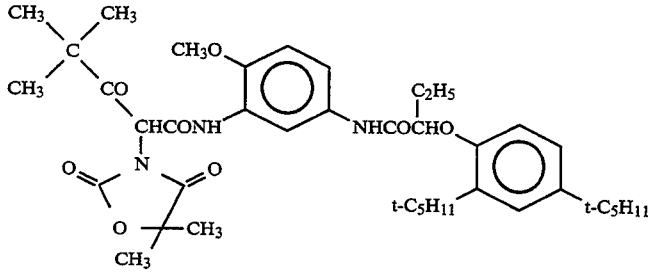
(Discoloration inhibitor 1)
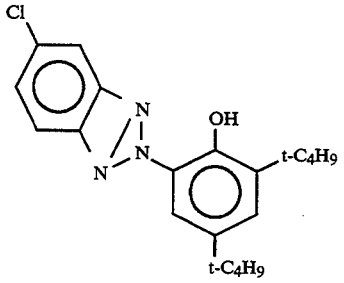
(Discoloration inhibitor 2)
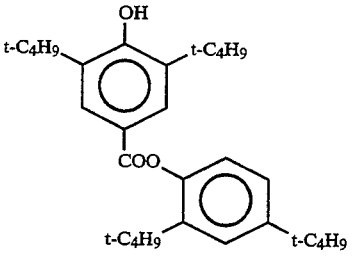
(Discoloration inhibitor 3)
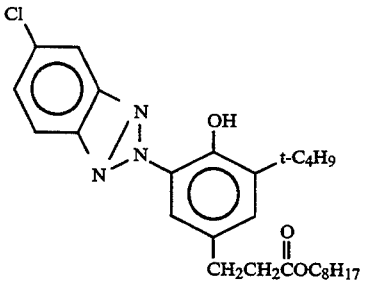
(Discoloration inhibitor 4)
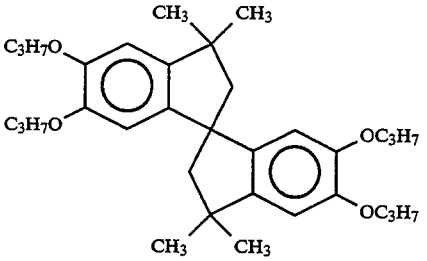
(Discoloration inhibitor 5)
(Dispersion medium)

-continued
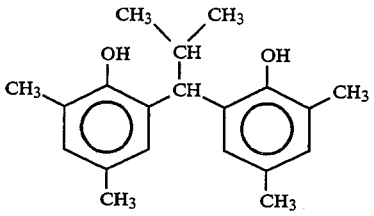
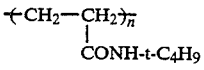
(n = 100–1000)
(Development accelerator)
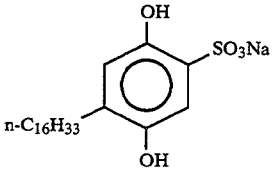
(Color stain inhibitor 1)
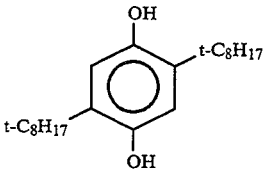
(Color stain inhibitor 2)
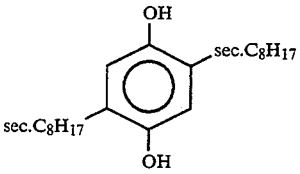
(Stain inhibitor 1)
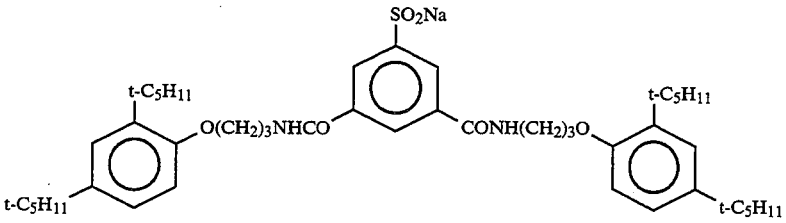
(Stain inhibitor 2)
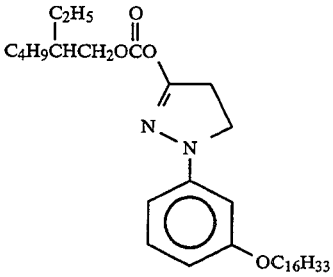
(Stain inhibitor 3)
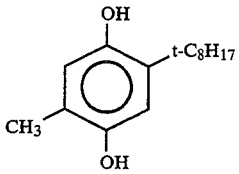
(Stain inhibitor 4)
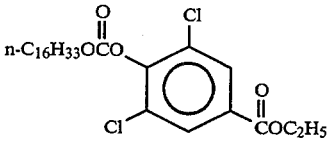
(Ultraviolet absorbent 1)
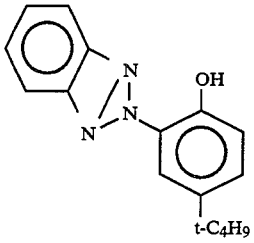
(Ultraviolet absorbent 2)
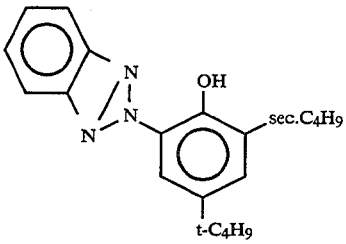
(Dye 1)
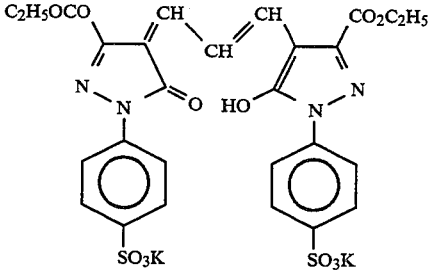
(Dye 2)
(Dye 3)

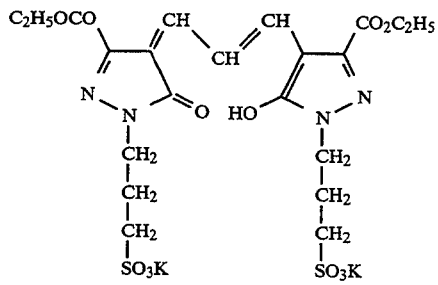

-continued

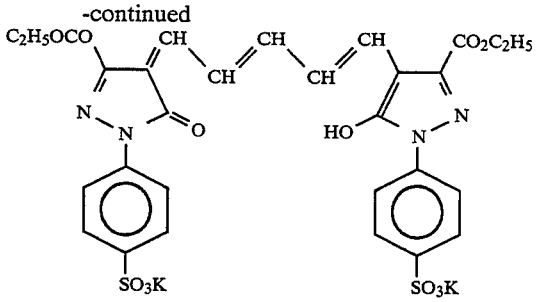

(Dye 4)

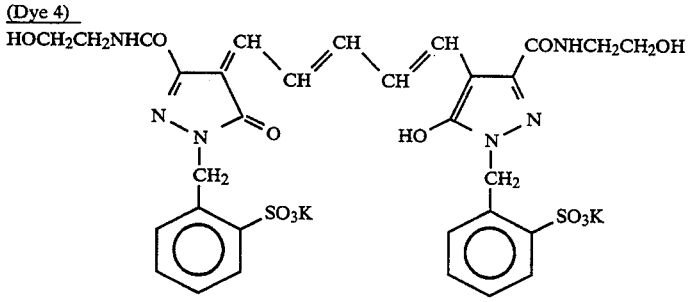

(Stabilizer 1)

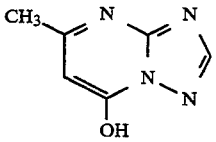

(Stabilizer 1)

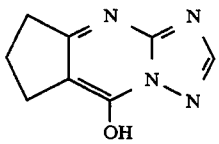

(Rot-proof agent 1)

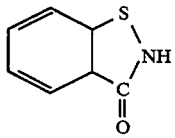

(Rot-proof agent 2)

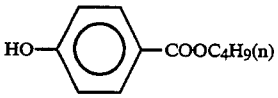

(Rot-proof agent 3)

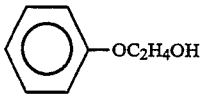

Preparation of Samples No. S-21 to S-29

The procedure for preparing the above sample S-20 was repeated except for adding the compounds set forth in Table 2 in the preparation stage of the emulsions EM-21, EM-22 and EM-23 used for the sixth layer and the seventh layer, to prepare samples No. S-21 to S-29.

Each of the samples (photographic materials) thus obtained was exposed through optical wedge for 0.5 seconds (200 CMS) and then subjected to development process (P-1) of the following successive steps using the following developing solutions. A characteristic curve was determined from the obtained image. Further, the sample was subjected to uniform exposure to obtain a gray image having a density of 1.0, and mottle of the image (unevenness of image) was measured using a microdensitometer.

| Process | Period (sec) | Temperature (°C.) | Volume of the tank | Replenishing amount |
|---|---|---|---|---|
| Black and Whiter Development | 75 | 38 | 8 liters | 330 ml/m$^2$ |
| 1st Washing (1st bath) | 45 | 33 | 5 liters | None |
| 1st Washing (2nd bath) | 45 | 33 | 5 liters | 5,000 ml/m$^2$ |
| Reversal Exposure | 15 (100 lux) | | | |

-continued

| Process | Period (sec) | Temperature (°C.) | Volume of the tank | Replenishing amount |
|---|---|---|---|---|
| Color Development | 135 | 38 | 15 liters | 330 ml/m$^2$ |
| 2nd Washing | 45 | 33 | 5 liters | 1,000 ml/m$^2$ |
| Bleach-fix (1st bath) | 60 | 38 | 7 liters | None |
| Bleach-fix (2nd bath) | 60 | 38 | 7 liters | 150 ml/m$^2$ |
| 3rd Washing (1st bath) | 45 | 33 | 5 liters | None |
| 3rd Washing (2nd bath) | 45 | 33 | 5 liters | None |
| 3rd Washing (3rd bath) | 45 | 33 | 5 liters | 5,000 ml/m$^2$ |
| Drying | 45 | 75 | | |

The first washing and the third washing were carried out by counter current washing system. That is, in the first washing stage, the washing water was introduced into the second bath and the overflowed solution of the second bath was introduced into the first bath. In the third washing stage, the washing water was introduced into the third bath, the overflowed solution of the third bath was introduced into the second bath, and the overflowed solution of the second bath was introduced into the first bath.

Followings are compositions of each processing solutions.

| | Mother liquid | Replenisher |
|---|---|---|
| Black and white developing solution (FD-1) | | |
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium bromide | 0.5 g | None |
| Potassium iodide | 5.0 mg | None |
| Water to make up to | 1,000 ml | 1,000 ml |
| pH (adjusted by hydrochloric acid or potassium hydroxide) | 9.60 | 9.70 |
| Color developing solution (CD-1) | | |
| Benzyl alcohol | 15.0 ml | 16.5 ml |
| Diethylene glycol | 12.0 ml | 14.0 ml |
| 3,6-dithia-1,8-octanediol | 0.2 g | 0.25 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 2.0 g | 2.5 g |
| Hydroxylaminesulfate | 3.0 g | 3.6 g |
| N-ethyl-N-(β-methanesulfonamideethyl)-3-methyl-aminoanilinesulfate | 5.0 g | 8.0 g |
| Brightening agent | 1.0 g | 1.2 g |
| Potassium bromide | 0.5 g | None |
| Potassium iodide | 1.0 mg | None |
| Water to make up to | 1,000 ml | 1,000 ml |
| pH (adjusted by hydrochloric acid or potassium hydroxide) | 10.25 | 10.40 |
| Bleach-fix solution | | |
| Disodium ethylenediaminetetraacetate dihydrate | 5.0 g | 5.0 g |
| Ammonium ethylenediaminetetraacetate Fe(III) monohydrate | 80.0 g | 80.0 g |
| Sodium sulfite | 15.0 g | 15.0 g |
| Ammonium thiosulfate aqueous solution (700 ml/l) | 160 ml | 160 ml |
| 2-mercapto-1,3,4-triazole | 0.5 g | 0.5 g |
| Water to make up to | 1,000 ml | 1,000 ml |
| pH (adjusted by acetic acid or ammonia water) | 6.50 | 6.50 |

The results are set forth in Table 2.

TABLE 2

| Test No. | Sample No. | Compound | Amount of Compound | Mottle × 100 RMS G | Sensitivity Difference 35/5° C. $\Delta S_{0.5}(G)$ | Sensitivity Reduction (40° C., 70%, 1 month) $\Delta S_{0.5}(G)$ |
|---|---|---|---|---|---|---|
| 201 | S-20 *1 | — | — | 3.26 | −0.12 | −0.35 |
| 202 | S-21 *1 | (a) | $3 \times 10^{-4}$ | 3.31 | −0.31 | −0.32 |
| 203 | S-22 *1 | (a) | $9 \times 10^{-4}$ | 3.34 | −0.12 | −0.33 |
| 204 | S-23 *2 | (9) | $1 \times 10^{-4}$ | 2.78 | −0.06 | −0.21 |
| 205 | S-24 *2 | (9) | $3 \times 10^{-4}$ | 2.54 | −0.04 | −0.18 |
| 206 | S-25 *2 | (9) | $9 \times 10^{-4}$ | 2.53 | −0.03 | −0.19 |
| 207 | S-26 *2 | (9) | $3 \times 10^{-4}$ | 2.51 | −0.04 | −0.18 |
| 208 | S-27 *2 | (6) | $3 \times 10^{-4}$ | 2.62 | −0.05 | −0.17 |
| 209 | S-28 *2 | (18) | $3 \times 10^{-4}$ | 2.67 | −0.04 | −0.20 |
| 210 | S-29 *2 | (5) | $3 \times 10^{-9}$ | 2.98 | −0.10 | −0.29 |

*1: sample for comparison
*2: sample according to the present invention

In Table 2, the amount is expressed by a molar ratio of a compound to silver halide, and the compound (a) is a compound represented by the following formula.

Compound (a)

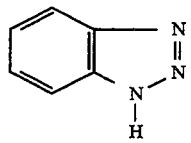

In table 2, each value for mottle (G) was determined in accordance with the following formula.

$$(G) = 100\sqrt{\frac{1}{L}\int_{O}^{L}(D(x) - D_{av})^2 dx}$$

In the above formula, D(x) is a density value of the gray image of the sample between Point 0 to Point 1 measured by G filter of a microdensitometer (aperture: 50 μm), and $D_{av}$ is a mean value of D(x). L is a distance between Point 0 and Point 1, and the value for mottle (G) is 100 times of a root mean square value of density ununiformity. As this value becomes larger, the mottle becomes larger. On the contrary, as this value becomes smaller, the mottle becomes smaller.

The sensitivity difference ($\Delta S_{0.5}(G)$, 35° C./5° C.) in Table 2 means a difference between an exposure light amount at an exposure temperature of 35° C. and an exposure light amount at an exposure temperature of 5° C., each providing a density value of 0.5. As the value for the sensitivity difference is near to 0, the stability of the sample to temperature change is good. The sensitivity reduction ($\Delta S_{0.5}(G)$, 40° C./70%/1 month) means a sensitivity reduction in the case where the sample before subjected to exposure is allowed to stand for 1 month at 40° C. and 70%. It is preferred that the value for sensitivity reduction is small.

As is evident from Table 2, in the tests 204 to 210 in which the samples of the invention S-23 to S-29 were used, occurrence of mottle was decreased, temperature dependence of the sensitivity was small, and storage properties were excellent. It is also apparent that higher effects were shown when the favorable compounds (6), (9) and (18) were used, as compared with a case of using the compound (5).

EXAMPLE 3

The procedure for preparing the emulsion EM-4 in Example 1 was repeated except for varying the temperature for the formation of the silver halide grains and the time required for adding the silver nitrate aqueous solution and the alkali halide aqueous solution, to prepare emulsions EM-41, EM-42 and EM-43 having grain sizes of 0.3 μm, 0.5 μm and 0.8 μm, respectively. The emulsions EM-41, EM-42 and EM-43 had grain size distributions of 0.08, 0.09 and 0.10, respectively.

In the similar manner, from the emulsion EM-5 were prepared emulsions EM-51, EM-52 and EM-53 having grain sizes of 0.3 μm, 0.5 μm and 0.8 μm, respectively. The emulsions EM-51, EM-52 and EM-53 had grain size distributions of 0.08, 0.09 and 0.09, respectively.

Further, in the similar manner, from the emulsion EM-6 were prepared emulsions EM-61, EM-62 and EM-36 having grain sizes of 0.4 μm, 0.55 μm and 1.1 μm, respectively. The emulsions EM-61, EM-62 and EM-63 had grain size distributions of 0.07, 0.09 and 0.12, respectively.

Preparation of Samples No. S-30 to S-39

The procedure of Example 2 was repeated except for using EM-41 to EM-43, EM-51 to EM-53, and EM-61 to EM-63 instead of EM-11 to EM-13, EM-21 to EM-23, and EM-31 to EM-33, to prepare samples No. S-31 to S-39.

Each of the samples (photographic materials) thus obtained was subjected to the same exposure and the same development (P-1) as described in Example 2. Further, the same measurements as described in Example 2 were carried out. The results are set forth in Table 3.

TABLE 3

| Test No. | Sample No. | Compound | Amount of Compound | Mottle × 100 RMS G | Sensitivity Difference 35/5° C. $\Delta S_{0.5}$(G) | Sensitivity Reduction (40° C., 70%, 1 month) $\Delta S_{0.5}$(G) |
|---|---|---|---|---|---|---|
| 301 | S-30 *1 | — | — | 3.58 | −0.11 | −0.28 |
| 302 | S-31 *1 | (a) | $3 \times 10^{-4}$ | 3.46 | −0.10 | −0.25 |
| 303 | S-32 *1 | (a) | $9 \times 10^{-4}$ | 3.51 | −0.13 | −0.25 |
| 304 | S-33 *2 | (9) | $1 \times 10^{-4}$ | 2.68 | −0.05 | −0.17 |
| 305 | S-34 *2 | (9) | $3 \times 10^{-4}$ | 2.43 | −0.03 | −0.16 |
| 306 | S-35 *2 | (9) | $9 \times 10^{-4}$ | 2.41 | −0.03 | −0.16 |
| 307 | S-36 *2 | (9) | $3 \times 10^{-4}$ | 2.38 | −0.03 | −0.17 |
| 308 | S-37 *2 | (6) | $3 \times 10^{-4}$ | 2.43 | −0.04 | −0.18 |
| 309 | S-38 *2 | (18) | $3 \times 10^{-4}$ | 2.47 | −0.04 | −0.17 |
| 310 | S-39 *2 | (5) | $3 \times 10^{-9}$ | 2.99 | −0.11 | −0.21 |

*1: sample for comparison
*2: sample according to the present invention

As is evident from Table 3, when the silver chloride type silver halide containing iodide (silver iodochloride) was used, occurrence of mottle was much more decreased, as compared with a case of using the silver chloride type silver halide not containing iodide (silver chloride). Further, temperature dependence of the exposure and storage properties were also improved.

EXAMPLE 4 with respect to the samples S-24, S-27, S-34 and S-38 of Examples 2 and 3, the same tests as described in Example 2 were carried out except that the development process P-1 was replaced with the following development processes P-21 to P-28.

In the development processes P-21 to p-28, the black and white developing solution (FD-1) of the development process P-1 was replaced with the solutions FD-21 to FD-28 set forth in the following Table 4a. Each of the following processing solutions FD-22, FD-23, FD-27 and FD-28 has a bromide concentration of not more than $1 \times 10^{-3}$ mol/l and sulfite ion of not more than $1 \times 10^{-1}$ mol/l. The results obtained by the tests are set forth in Table 4b.

TABLE 4a-1

| Black and white developing solution (FD-21) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.05 g | None |
| Water to make up to | 1,000 ml | 1,000 ml |
| pH (adjusted by hydrochloric acid or potassium hydroxide) | 9.60 | 9.70 |
| Replenishing amount (ml/m$^2$) | | 110 |

TABLE 4a-2

| Black and white developing solution (FD-22) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 2.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.05 g | None |
| Water to make up to | 1,000 ml | 1,000 ml |
| pH (adjusted by hydrochloric acid or potassium hydroxide) | 9.60 | 9.70 |
| Replenishing amount (ml/m$^2$) | | 110 |

TABLE 4a-3

| Black and white developing solution (FD-23) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 0.5 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.05 g | None |
| Water to make up to | 1,000 ml | 1,000 ml |
| pH (adjusted by hydrochloric acid or potassium hydroxide) | 9.60 | 9.70 |
| Replenishing amount (ml/m$^2$) | | 110 |

TABLE 4a-4

| Black and white developing solution (FD-24) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |

TABLE 4a-4-continued

| Black and white developing solution (FD-24) | Mother liquid | Replenisher |
|---|---|---|
| Potassium sulfite | 2.0 g | 30.0 g |
| Potassium thiocyanate | 1.2 g | 1.2 g |
| Potassium carbonate | 35.0 g | 35.0 g |
| Potassium hydroquinonemono-sulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.5 g | 0.5 g |
| Water to make up to | 1,000 ml | 1,000 ml |
| pH | 9.60 | 9.70 |
| (adjusted by hydrochloric acid or potassium hydroxide) | | |
| Replenishing amount (ml/m$^2$) | | 110 |

TABLE 4a-5

| Black and white developing solution (FD-25) | Mother liquid | Replenisher |
|---|---|---|
| Pentasodium nitrilo-N,N,N-trimethylenephosphonate | 1.0 g | 1.0 g |
| Pentasodium diethylenetriamine-pentaacetate | 3.0 g | 3.0 g |
| Potassium sulfite | 0.5 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.5 g | 0.5 g |
| Water to make up to | 1,000 ml | 1,000 ml |
| pH | 9.60 | 9.70 |
| (adjusted by hydrochloric acid or potassium hydroxide) | | |
| Replenishing amount (ml/m$^2$) | | 110 |

TABLE 4a-6

| Black and white developing solution (FD-26) | Mother liquid | Replenisher |
|---|---|---|
| Pentasodium nitrilo-N,N,N-trimethylenephosphonate | 1.0 g | 1.0 g |
| Pentasodium diethylenetriamine-pentaacetate | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | None | None |
| Water to make up to | 1,000 ml | 1,000 ml |
| pH | 9.60 | 9.70 |
| (adjusted by hydrochloric acid or potassium hydroxide) | | |
| Replenishing amount (ml/m$^2$) | | 110 |

TABLE 4a-7

| Black and white developing solution (FD-27) | Mother liquid | Replenisher |
|---|---|---|
| Pentasodium nitrilo-N,N,N-trimethylenephosphonate | 1.0 g | 1.0 g |
| Pentasodium diethylenetriamine-pentaacetate | 3.0 g | 3.0 g |
| Potassium sulfite | 2.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | None | None |
| Water to make up to | 1,000 ml | 1,000 ml |
| pH | 9.60 | 9.70 |
| (adjusted by hydrochloric acid or potassium hydroxide) | | |
| Replenishing amount (ml/m$^2$) | | 110 |

TABLE 4a-8

| Black and white developing solution (FD-28) | Mother liquid | Replenisher |
|---|---|---|
| Pentasodium nitrilo-N,N,N-trimethylenephosphonate | 1.0 g | 1.0 g |
| Pentasodium diethylenetriamine-pentaacetate | 3.0 g | 3.0 g |
| Potassium sulfite | 0.5 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | None | None |
| Water to make up to | 1,000 ml | 1,000 ml |
| pH | 9.60 | 9.70 |
| (adjusted by hydrochloric acid or potassium hydroxide) | | |
| Replenishing amount (ml/m$^2$) | | 110 |

TABLE 4b

| Test No. | Sample No. | Development | Mottle (G) × 1000 RMS |
|---|---|---|---|
| 401 | S-24 | P-21 | 2.52 |
| 402 | S-27 | P-21 | 2.59 |
| 403 | S-34 | P-21 | 2.40 |
| 404 | S-38 | P-21 | 2.45 |
| 405 | S-24 | P-22 | 1.91 |
| 406 | S-27 | P-22 | 1.98 |
| 407 | S-34 | P-22 | 1.89 |
| 408 | S-38 | P-22 | 1.91 |
| 409 | S-24 | P-23 | 1.89 |
| 410 | S-27 | P-23 | 1.93 |
| 411 | S-34 | P-23 | 1.82 |
| 412 | S-38 | P-23 | 1.86 |
| 413 | S-24 | P-24 | 2.53 |
| 414 | S-27 | P-24 | 2.58 |
| 415 | S-34 | P-24 | 2.43 |
| 416 | S-38 | P-24 | 2.44 |
| 417 | S-24 | P-25 | 2.51 |
| 418 | S-27 | P-25 | 2.60 |
| 419 | S-34 | P-25 | 2.44 |
| 420 | S-38 | P-25 | 2.44 |
| 421 | S-24 | P-26 | 2.52 |
| 422 | S-27 | P-26 | 2.60 |
| 423 | S-34 | P-26 | 2.40 |
| 424 | S-38 | P-26 | 2.44 |
| 425 | S-24 | P-27 | 1.87 |
| 426 | S-27 | P-27 | 1.91 |
| 427 | S-34 | P-27 | 1.80 |
| 428 | S-38 | P-27 | 1.83 |
| 429 | S-24 | P-28 | 1.79 |
| 430 | S-27 | P-28 | 1.80 |
| 431 | S-34 | P-28 | 1.70 |
| 432 | S-38 | P-28 | 1.75 |

As is evident from Table 4b, in the tests No. 405 to 412, and 425 to 432 using a processing solution having bromide ion of not more than $1\times10^{-1}$ mol/l and sulfite ion of not more than $1\times10^{-1}$ mol/l, occurrence of mottle was much more decreased as compared with the tests using processing solutions of Examples 2 and 3.

EXAMPLE 5

With respect to the samples S-24, S-27, S-34 and S-38 of Examples 2 and 3, the same tests as described in Example 2 were carried out except that the development process P-1 was replaced with the following development processes P-31 to P-33.

In the development processes P-31 to p-33, the black and white developing solution (FD-1) of the development process P-1 was replaced with the solutions FD-31 to FD-33 set forth in the following Table 5a. Each of the following processing solutions FD-32 and FD-33 has a chloride concentration of $5\times10^{-3}$ mol/l to $1\times10^{-1}$ mol/l. The results obtained by the tests are set forth in Table 5b.

TABLE 5a-1

| Black and white developing solution (FD-31) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.1 g | None |
| Potassium bromide | 0.2 g | 0.1 g |
| Water to make up to | 1,000 ml | 1,000 ml |
| pH (adjusted by hydrochloric acid or potassium hydroxide) | 2.60 | 9.70 |
| Replenishing amount (ml/m$^2$) | | 110 |

TABLE 5a-2

| Black and white developing solution (FD-32) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.4 g | None |
| Potassium bromide | 0.2 g | 0.1 g |
| Water to make up to | 1,000 ml | 1,000 ml |
| pH (adjusted by hydrochloric acid or potassium hydroxide) | 2.60 | 9.70 |
| Replenishing amount (ml/m$^2$) | | 110 |

TABLE 5a-3

| Black and white developing solution (FD-33) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.8 g | None |
| Potassium bromide | 0.2 g | 0.1 g |
| Water to make up to | 1,000 ml | 1,000 ml |
| pH (adjusted by hydrochloric acid or potassium hydroxide) | 2.60 | 9.70 |

TABLE 5a-3-continued

| Black and white developing solution (FD-33) | Mother liquid | Replenisher |
|---|---|---|
| Replenishing amount (ml/m$^2$) | | 110 |

TABLE 5b

| Test No. | Sample No. | Development | Mottle (G) × 1000 RMS |
|---|---|---|---|
| 501 | S-24 | P-31 | 2.53 |
| 502 | S-27 | P-31 | 2.58 |
| 503 | S-34 | P-31 | 2.42 |
| 504 | S-38 | P-31 | 2.47 |
| 505 | S-24 | P-32 | 1.93 |
| 506 | S-27 | P-32 | 1.97 |
| 507 | S-34 | P-32 | 1.93 |
| 508 | S-38 | P-32 | 1.96 |
| 509 | S-24 | P-33 | 1.88 |
| 510 | S-27 | P-33 | 1.91 |
| 511 | S-34 | P-33 | 1.80 |
| 512 | S-38 | P-33 | 1.85 |

As is evident from Table 5b, in the tests No. 505 to 512 using a processing solution having chloride ion of $5\times10^{-3}$ mol/l to $1\times10^{-1}$ mol/l, occurrence of mottle was much more decreased, as compared with the tests using processing solutions of Examples 2 and 3.

EXAMPLE 6

With respect to the samples S-24, S-27, S-34 and S-38 of Examples 2 and 3, the same tests as described in Example 2 were carried out except that the development process P-1 was replaced with the following development processes P-41 to P-45.

In the development processes P-41 to p-45, the black and white developing solution (FD-1) of the development process P-1 was replaced with the solutions FD-41 to FD-45 set forth in the following Table 6a. Each of the following processing solutions FD-42, FD-44 and FD-45 has rhodanide ion of not more than $1\times10^{-2}$ mol/l. The results obtained by the tests are set forth in Table 6b.

TABLE 6a-1

| Black and white developing solution (FD-41) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.2 g | 0.2 g |
| Water to make up to | 1,000 ml | 1,000 ml |
| pH (adjusted by hydrochloric acid or potassium hydroxide) | 9.60 | 9.70 |
| Replenishing amount (ml/m$^2$) | | 110 |

TABLE 6a-2

| Black and white developing solution (FD-42) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 0.5 g | 30.0 g |
| Potassium thiocyanate | 0.1 g | 0.1 g |

TABLE 6a-2-continued

| Black and white developing solution (FD-42) | Mother liquid | Replenisher |
|---|---|---|
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.2 g | 0.2 g |
| Water to make up to | 1,000 ml | 1,000 ml |
| pH (adjusted by hydrochloric acid or potassim hydroxide) | 9.60 | 9.70 |
| Replenishing amount (ml/m$^2$) | | 110 |

TABLE 6a-3

| Black and white developing solution (FD-43) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 0.5 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.2 g | 0.2 g |
| Water to make up to | 1,000 ml | 1,000 ml |
| pH (adjusted by hydrochloric acid or potassium hydroxide) | 9.60 | 9.70 |
| Replenishing amount (ml/m$^2$) | | 110 |

TABLE 6a-4

| Black and white developing solution (FD-44) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 0.5 g | 30.0 g |
| Potassium thiocyanate | 0.0 g | 0.0 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |
| Potassium bromide | 0.2 g | 0.2 g |
| Water to make up to | 1,000 ml | 1,000 ml |
| pH (adjusted by hydrochloric acid or potassium hydroxide) | 9.60 | 9.70 |
| Replenishing amount (ml/m$^2$) | | 110 |

TABLE 6a-5

| Black and white developing solution (FD-45) | Mother liquid | Replenisher |
|---|---|---|
| Pentasodium nitrilo-N,N,N-trimethylenephosphonate | 1.0 g | 1.0 g |
| Pentasodium diethylenetriaminepentaacetate | 3.0 g | 3.0 g |
| Potassium sulfite | 0.5 g | 30.0 g |
| Potassium thiocyanate | 0.0 g | 0.0 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.2 g | None |

TABLE 6a-5-continued

| Black and white developing solution (FD-45) | Mother liquid | Replenisher |
|---|---|---|
| Potassium bromide | 0.2 g | 0.2 g |
| Water to make up to | 1,000 ml | 1,000 ml |
| pH (adjusted by hydrochloric acid or potassium hydroxide) | 9.60 | 9.70 |
| Replenishing amount (ml/m$^2$) | | 110 |

TABLE 6b

| Test No. | Sample No. | Development | Mottle (G) × 1000 RMS |
|---|---|---|---|
| 601 | S-24 | P-41 | 2.12 |
| 602 | S-27 | P-41 | 2.47 |
| 603 | S-34 | P-41 | 2.00 |
| 604 | S-38 | P-41 | 2.03 |
| 605 | S-24 | P-42 | 1.61 |
| 606 | S-27 | P-42 | 1.68 |
| 607 | S-34 | P-42 | 1.66 |
| 608 | S-38 | P-42 | 1.62 |
| 609 | S-24 | P-43 | 2.02 |
| 610 | S-27 | P-43 | 2.08 |
| 611 | S-34 | P-43 | 1.98 |
| 612 | S-38 | P-43 | 1.92 |
| 613 | S-24 | P-44 | 1.63 |
| 614 | S-27 | P-44 | 1.62 |
| 615 | S-34 | P-44 | 1.45 |
| 616 | S-38 | P-44 | 1.42 |
| 617 | S-24 | P-45 | 1.31 |
| 618 | S-27 | P-45 | 1.34 |
| 619 | S-34 | P-45 | 1.23 |
| 620 | S-38 | P-45 | 1.31 |

As is evident from Table 6b, in the tests No. 605 to 508, 613 and 620 using a processing solution having rhodanide ion of not more than $1\times10^{-2}$ mol/l, occurrence of mottle was much more decreased.

EXAMPLE 7

With respect to the samples S-24, S-27, S-34 and S-38 of Examples 2 and 3, the same tests as described in Example 2 were carried out except that the development process P-1 was replaced with the following development processes P-51 to P-58.

In the development processes P-51 to p-58, the color developing solution (CD-1) of the development process P-1 was replaced with the solutions CD-51 to CD-58 set forth in the following Table 7a. Each of the following processing solutions CD-52, CD-53, CD-57 and CD-58 has bromide ion of not more than $1\times10^{-3}$ mol/l and sulfite ion of not more than $1\times^{-2}$ mol/l. The results obtained by the tests are set forth in Table 7b.

TABLE 7a-1

| Color developing solution (CD-51) | Mother liquid | Replenisher |
|---|---|---|
| Benzyl alcohol | 15.0 ml | 16.5 ml |
| Diethylene glycol | 12.0 ml | 14.0 ml |
| 3,6-dithia-1,8-octanediol | 0.05 g | 0.05 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 0.2 g | 0.2 g |
| Hydoxylaminesulfate | 3.0 g | 3.6 g |
| N-ethyl-N-(β-methanesulfonamideethyl)-3-methyl-aminoanilinesulfate | 5.0 g | 8.0 g |
| Brightening agent (diaminostilbene type) | 1.0 g | 1.2 g |
| Potassium chloride | 0.2 g | None |
| Potassium bromide | 0.5 g | None |
| Water to make up to | 1,000 ml | 1,000 ml |

TABLE 7a-1-continued

| Color developing solution (CD-51) | Mother liquid | Replenisher |
|---|---|---|
| pH (adjusted by hydrochloric acid or potassium hydroxide) | 10.25 | 10.40 |
| Replenishing amount (ml/m$^2$) | | 110 |

TABLE 7a-2

| Color developing solution (CD-52) | Mother liquid | Replenisher |
|---|---|---|
| Benzyl alcohol | 15.0 ml | 16.5 ml |
| Diethylene glycol | 12.0 ml | 14.0 ml |
| 3,6-dithia-1,8-octanediol | 0.05 g | 0.05 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 0.2 g | 0.2 g |
| Hydroxylaminesulfate | 3.0 g | 3.6 g |
| N-ethyl-N-(β-methanesulfonamideethyl)-3-methyl-aminoanilinesulfate | 5.0 g | 8.0 g |
| Brightening agent (diaminostilbene type) | 1.0 g | 1.2 g |
| Potassium chloride | 0.2 g | None |
| Potassium bromide | 0.1 g | None |
| Water to make up to | 1,000 ml | 1,000 ml |
| pH (adjusted by hydrochloric acid or potassium hydroxide) | 10.25 | 10.45 |
| Replenishing amount (ml/m$^2$) | | 110 |

TABLE 7a-3

| Color developing solution (CD-53) | Mother liquid | Replenisher |
|---|---|---|
| Benzyl alcohol | 15.0 ml | 16.5 ml |
| Diethylene glycol | 12.0 ml | 14.0 ml |
| 3,6-dithia-1,8-octanediol | 0.05 g | 0.05 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 0.2 g | 0.2 g |
| Hydroxylaminesulfate | 3.0 g | 3.6 g |
| N-ethyl-N-(β-methanesulfonamideethyl)-3-methyl-aminoanilinesulfate | 5.0 g | 8.0 g |
| Brightening agent (diaminostilbene type) | 1.0 g | 1.2 g |
| Potassium chloride | 0.2 g | None |
| Potassium bromide | None | None |
| Water to make up to | 1,000 ml | 1,000 ml |
| pH (adjusted by hydrochloric acid or potassium hydroxide) | 10.25 | 10.45 |
| Replenishing amount (ml/m$^2$) | | 110 |

TABLE 7a-4

| Color developing solution (CD-54) | Mother liquid | Replenisher |
|---|---|---|
| Benzyl alcohol | 15.0 ml | 16.5 ml |
| Diethylene glycol | 12.0 ml | 14.0 ml |
| 3,6-dithia-1,8-octanediol | 0.05 g | 0.05 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 2.0 g | 2.5 g |
| Hydroxylaminesulfate | 3.0 g | 3.6 g |
| N-ethyl-N-(β-methanesulfonamidethyl)-3-methyl-aminoanilinesulfate | 5.0 g | 8.0 g |
| Brightening agent (diaminostilbene type) | 1.0 g | 1.2 g |

TABLE 7a-4-continued

| Color developing solution (CD-54) | Mother liquid | Replenisher |
|---|---|---|
| Potassium chloride | 0.2 g | None |
| Potassium bromide | 0.1 g | None |
| Water to make up to | 1,000 ml | 1,000 ml |
| pH (adjusted by hydrochloric acid or potassium hydroxide) | 10.25 | 10.45 |
| Replenishing amount (ml/m$^2$) | | 110 |

TABLE 7a-5

| Color developing solution (CD-55) | Mother liquid | Replenisher |
|---|---|---|
| Benzyl alcohol | 15.0 ml | 16.5 ml |
| Diethylene glycol | 12.0 ml | 14.0 ml |
| 3,6-dithia-1,8-octanediol | 0.05 g | 0.05 g |
| Pentasodium nitrilo-N,N,N-tri-methylenephosphonate | 0.5 g | 0.5 g |
| Pentasodium diethylenetriaminepenta-acetate | 2.0 g | 2.0 g |
| Sodium sulfite | 2.0 g | 2.5 g |
| Hydoxylaminesulfate | 3.0 g | 3.6 g |
| N-ethyl-N-(β-methanesulfonamide-ethyl)-3-methyl-aminoanilinessulfate | 5.0 g | 8.0 g |
| Brightening agent (diaminostilbene type) | 1.0 g | 1.2 g |
| Potassium chloride | 0.2 g | None |
| Potassium bromide | None | None |
| Water to make up to | 1,000 ml | 1,000 ml |
| pH (adjusted by hydrochloric acid or potassium hydroxide) | 10.25 | 10.45 |
| Replenishing amount (ml/m$^2$) | | 110 |

TABLE 7a-6

| Color developing solution (CD-56) | Mother liquid | Replenisher |
|---|---|---|
| Benzyl alcohol | 15.0 ml | 16.5 ml |
| Diethylene glycol | 12.0 ml | 14.0 ml |
| 3,6-dithia-1,8-octanediol | 0.05 g | 0.05 g |
| Pentasodium nitrilo-N,N,N-tri-methylenephosphonate | 0.5 g | 0.5 g |
| Pentasodium diethylenetriaminepenta-acetate | 2.0 g | 2.0 g |
| Sodium sulfite | None | None |
| Hydoxylaminesulfate | 3.0 g | 3.6 g |
| N-ethyl-N-(β-methanesulfonamide-ethyl)-3-methyl-aminoanilinessulfate | 5.0 g | 8.0 g |
| Brightening agent (diaminostilbene type) | 1.0 g | 1.2 g |
| Potassium chloride | 0.2 g | None |
| Potassium bromide | 0.5 g | None |
| Water to make up to | 1,000 ml | 1,000 ml |
| pH (adjusted by hydrochloric acid or potassium hydroxide) | 10.25 | 10.45 |
| Replenishing amount (ml/m$^2$) | | 110 |

TABLE 7a-7

| Color developing solution (CD-57) | Mother liquid | Replenisher |
|---|---|---|
| Benzyl alcohol | 15.0 ml | 16.5 ml |
| Diethylene glycol | 12.0 ml | 14.0 ml |
| 3,6-dithia-1,8-octanediol | 0.05 g | 0.05 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | None | None |
| Hydroxylaminesulfate | 3.0 g | 3.6 g |
| N-ethyl-N-(β-methanesulfonamideethyl)-3-methyl- | 5.0 g | 8.0 g |

TABLE 7a-7-continued

| Color developing solution (CD-57) | Mother liquid | Replenisher |
|---|---|---|
| aminoanilinesulfate | | |
| Brightening agent (diaminostilbene type) | 1.0 g | 1.2 g |
| Potassium chloride | 0.2 g | None |
| Potassium bromide | 0.1 g | None |
| Water to make up to | 1,000 ml | 1,000 ml |
| pH (adjusted by hydrochloric acid or potassium hydroxide) | 10.25 | 10.45 |
| Replenishing amount (ml/m$^2$) | | 110 |

TABLE 7a-8

| Color developing solution (CD-58) | Mother liquid | Replenisher |
|---|---|---|
| Benzyl alcohol | 15.0 ml | 16.5 ml |
| Diethylene glycol | 12.0 ml | 14.0 ml |
| 3,6-dithia-1,8-octanediol | 0.05 g | 0.05 g |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | None | None |
| Hydroxylaminesulfate | 3.0 g | 3.6 g |
| N-ethyl-N-(β-methanesulfonamideethyl)-3-methyl-aminoanilinesulfate | 5.0 g | 8.0 g |
| Brightening agent | 1.0 g | 1.2 g |
| Potassium chloride | 0.2 g | None |
| Potassium bromide | None | None |
| Water to make up to | 1,000 ml | 1,000 ml |
| pH (adjusted by hydrochloric acid or potassium hydroxide) | 10.25 | 10.45 |
| Replenishing amount (ml/m$^2$) | | 110 |

TABLE 7b

| Test No. | Sample No. | Development | Mottle (G) × 1000 RMS |
|---|---|---|---|
| 701 | S-24 | P-51 | 2.52 |
| 702 | S-27 | P-51 | 2.58 |
| 703 | S-34 | P-51 | 2.42 |
| 704 | S-38 | P-51 | 2.45 |
| 705 | S-24 | P-52 | 1.90 |
| 706 | S-27 | P-52 | 1.90 |
| 707 | S-34 | P-52 | 1.81 |
| 708 | S-38 | P-52 | 1.87 |
| 709 | S-24 | P-53 | 1.82 |
| 710 | S-27 | P-53 | 1.87 |
| 711 | S-34 | P-53 | 1.79 |
| 712 | S-38 | P-53 | 1.78 |
| 713 | S-24 | P-54 | 2.53 |
| 714 | S-27 | P-54 | 2.57 |
| 715 | S-34 | P-54 | 2.40 |
| 716 | S-38 | P-54 | 2.44 |
| 717 | S-24 | P-55 | 2.51 |
| 718 | S-27 | P-55 | 2.59 |
| 719 | S-34 | P-55 | 2.41 |
| 720 | S-38 | P-55 | 2.42 |
| 721 | S-24 | P-56 | 2.50 |
| 722 | S-27 | P-56 | 2.59 |
| 723 | S-34 | P-56 | 2.41 |
| 724 | S-38 | P-56 | 2.42 |
| 725 | S-24 | P-57 | 1.83 |
| 726 | S-27 | P-57 | 1.88 |
| 727 | S-34 | P-57 | 1.71 |
| 728 | S-38 | P-57 | 1.78 |
| 729 | S-24 | P-58 | 1.74 |
| 730 | S-27 | P-58 | 1.75 |
| 731 | S-34 | P-58 | 1.66 |
| 732 | S-38 | P-58 | 1.63 |

As is evident from Table 7b, in the tests No. 705 to 712, and 725 to 732 using a processing solution having bromide ion of not more than $1\times10^{-3}$ mol/l and sulfite ion of not more than $1\times10^{-2}$ mol/l, occurrence of mottle was decreased.

EXAMPLE 8

With respect to the samples S-24, S-27, S-34 and S-38 of Examples 2 and 3, the same tests as described in Example 2 were carried out except that the development process P-1 was replaced with the following development processes P-61 to P-64.

In the development processes P-61 to p-64, the color developing solution (CD-1) of the development process P-1 was replaced with the solutions CD-61 to CD-64 set forth in the following Table 8a. Each of the following processing solutions CD-63 and CD-64 has chloride ion of $5\times10^{-3}$ mol/l to $1\times10^{-1}$ mol/l. The results obtained by the tests are set forth in Table 8b.

TABLE 8a-1

| Color developing solution (CD-61) | Mother liquid | Replenisher |
|---|---|---|
| Benzyl alcohol | 15.0 ml | 16.5 ml |
| Diethylene glycol | 12.0 ml | 14.0 ml |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 0.5 g | 0.7 g |
| N-ethyl-N-(β-methanesulfonamideethyl)-3-methyl-aminoanilinesulfate | 5.0 g | 8.0 g |
| Brightening agent (diaminostilbene type) | 1.0 g | 1.2 g |
| Potassium chloride | 0.1 g | None |
| Potassium bromide | 0.05 g | None |
| Water to make up to | 1,000 ml | 1,000 ml |
| pH (adjusted by hydrochloric acid or potassium hydroxide) | 10.25 | 10.40 |
| Replenishing amount (ml/m$^2$) | | 110 |

TABLE 8a-2

| Color developing solution (CD-62) | Mother liquid | Replenisher |
|---|---|---|
| Benzyl alcohol | 15.0 ml | 16.5 ml |
| Diethylene glycol | 12.0 ml | 14.0 ml |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 0.5 g | 0.7 g |
| N-ethyl-N-(β-methanesulfonamideethyl)-3-methyl-aminoanilinesulfate | 5.0 g | 8.0 g |
| Brightening agent (diaminostilbene type) | 1.0 g | 1.2 g |
| Potassium chloride | 0.1 g | None |
| Potassium bromide | 0.05 g | None |
| Water to make up to | 1,000 ml | 1,000 ml |
| pH (adjusted by hydrochloric acid or potassium hydroxide) | 10.25 | 10.40 |
| Replenishing amount (ml/m$^2$) | | 110 |

TABLE 8a-3

| Color developing solution (CD-63) | Mother liquid | Replenisher |
|---|---|---|
| Benzyl alcohol | 15.0 ml | 16.5 ml |
| Diethylene glycol | 12.0 ml | 14.0 ml |
| Pentasodium nitrilo-N,N,N-trimethylenephosphonate | 0.5 g | 0.5 g |
| Pentasodium diethylenetriaminepentaacetate | 2.0 g | 2.0 g |
| Sodium sulfite | 0.5 g | 0.7 g |
| N-ethyl-N-(β- | 5.0 g | 8.0 g |

TABLE 8a-3-continued

| Color developing solution (CD-63) | Mother liquid | Replenisher |
|---|---|---|
| methanesulfonamideethyl)-3-methyl-aminoanilinesulfate | | |
| Brightening agent | 1.0 g | 1.2 g |
| Potassium chloride | 0.5 g | None |
| Potassium bromide | 0.05 g | None |
| Water to make up to | 1,000 ml | 1,000 ml |
| pH (adjusted by hydrochloric acid or potassium hydroxide) | 10.25 | 10.40 |
| Replenishing amount (ml/m$^2$) | | 110 |

TABLE 8a-4

| Color developing solution (CD-64) | Mother liquid | Replenisher |
|---|---|---|
| Benzyl alcohol | 15.0 ml | 16.5 ml |
| Diethylene glycol | 12.0 ml | 14.0 ml |
| Pentasodium nitrilo-N,N,N-trimethylenephosphonate | 0.5 g | 0.5 g |
| Pentasodium diethylenetriamine-pentaacetate | 2.0 g | 2.0 g |
| Sodium sulfite | 0.5 g | 0.7 g |
| N-ethyl-N-(β-methanesulfonamide-ethyl)-3-methylaminoanilinesulfate | 5.0 g | 8.0 g |
| Brightening agent (diaminostilbene type) | 1.0 g | 1.2 g |
| Potassium chloride | 0.8 g | None |
| Potassium bromide | 0.05 g | None |
| Water to make up to | 1,000 ml | 1,000 ml |
| pH (adjusted by hydrochloric acid or potassium hydroxide) | 10.25 | 10.45 |
| Replenishing amount (ml/m$^2$) | | 110 |

TABLE 8b

| Test No. | Sample No. | Development | Mottle (G) × 1000 RMS |
|---|---|---|---|
| 801 | S-24 | P-61 | 2.32 |
| 802 | S-27 | P-61 | 2.30 |
| 803 | S-34 | P-61 | 2.20 |
| 804 | S-38 | P-61 | 2.15 |
| 805 | S-24 | P-62 | 1.31 |
| 806 | S-27 | P-62 | 1.37 |
| 807 | S-34 | P-62 | 1.29 |
| 808 | S-38 | P-62 | 1.21 |
| 809 | S-24 | P-63 | 1.35 |
| 810 | S-27 | P-63 | 1.33 |
| 811 | S-34 | P-63 | 1.27 |
| 812 | S-38 | P-63 | 1.28 |
| 813 | S-24 | P-64 | 2.36 |
| 814 | S-27 | P-64 | 2.38 |
| 815 | S-34 | P-64 | 2.23 |
| 816 | S-38 | P-64 | 2.25 |

As is evident from Table 8b, in the tests No. 805 to 812 using a processing solution having chloride ion of $5\times10^{-3}$ mol/l to $1\times10^{-1}$ mol/l, occurrence of mottle was decreased.

EXAMPLE 9

With respect to the samples S-24, S-27, S-34 and S-38 of Examples 2 and 3, the same tests as described in Example 2 were carried out except that the development P-1 process was replaced with the following development process P-71.

Steps of the development process P-71 and compositions of the processing solutions used in the development process are given below. Each of the black and white developing solution and the color developing solution has bromide ion of not more than $1\times10^{-3}$ mol/l. The results obtained by the tests are set forth in Table 9

| Process (p-71) | Period (sec) | Temperature (°C.) | Volume of the tank | Replenishing amount |
|---|---|---|---|---|
| Black and White Development | 20 | 38 | 8 liters | 75 ml/m$^2$ |
| 1st Washing (1st bath) | 20 | 33 | 5 liters | None |
| 1st Washing (2nd bath) | 20 | 33 | 5 liters | 1,000 ml/m$^2$ |
| Reversal Exposure | 15 (100 lux) | | | |
| Color Development | 40 | 38 | 15 liters | 75 ml/m$^2$ |
| 2nd Washing | 20 | 33 | 5 liters | 500 ml/m$^2$ |
| Bleach-fix (1st bath) | 20 | 38 | 7 liters | None |
| Bleach-fix (2nd bath) | 20 | 38 | 7 liters | 75 ml/m$^2$ |
| 3rd Washing (1st bath) | 20 | 33 | 5 liters | None |
| 3rd Washing (2nd bath) | 20 | 33 | 5 liters | None |
| 3rd Washing (3rd bath) | 20 | 33 | 5 liters | 1,000 ml/m$^2$ |
| Drying | 30 | 75 | | |

The first washing and the third washing were carried out by counter current washing system. That is, in the first washing stage, the washing water was introduced into the second bath and the overflowed solution of the second bath was introduced into the first bath. In the third washing stage, the washing water was introduced into the third bath, the overflowed solution of the third bath was introduced into the second bath, and the overflowed solution of the second bath was introduced into the first bath.

Followings are compositions of each processing solutions.

| | Mother liquid | Replenisher |
|---|---|---|
| Black and white developing solution | | |
| Pentasodium nitrilo-N,N,N-trimethylenephosphonate | 1.0 g | 1.0 g |
| Pentasodium diethylenetriamine-pentaacetate | 3.0 g | 3.0 g |
| Potassium carbonate | 35.0 g | 35.0 g |
| Potassium hydroquinonemonosulfonate | 25.0 g | 25.0 g |
| 1-phenyl-4-hydroxymethyl-4-methyl-3-pyrazolidone | 2.0 g | 2.0 g |
| Potassium chloride | 0.5 g | None |
| Water to make up to | 1,000 ml | 1,000 ml |
| pH (adjusted by hydrochloric acid or potassium hydroxide) | 9.60 | 9.70 |
| Color developing solution | | |
| Pentasodium nitrilo-N,N,N-trimethylenephosphonate | 0.5 g | 0.5 g |
| Pentasodium diethylenetriamine-pentaacetate | 2.0 g | 2.0 g |
| N-ethyl-N-(β-methanesulfonamide-ethyl)-3-methylaminoanilinesulfate | 5.0 g | 11.0 g |
| Brightening agent (diaminostilbene type) | 1.0 g | 1.4 g |
| Potassium chloride | 0.2 g | None |
| Water to make up to | 1,000 ml | 1,000 ml |
| pH (adjusted by hydrochloric acid or potassium hydroxide) | 10.25 | 10.45 |

TABLE 9

| Test No. | Sample No. | Development | Mottle (G) × 100 RMS | Difference of sensitivity ($\Delta S_{0.5}$ (G)) 35/5° C. |
|---|---|---|---|---|
| 801 | S-24 | P-7 | 1.12 | −0.01 |
| 802 | S-27 | P-7 | 1.23 | −0.02 |
| 803 | S-34 | P-7 | 0.98 | −0.00 |
| 804 | S-38 | P-7 | 1.09 | −0.01 |
| 205 | S-24 | P-1 | 2.54 | −0.04 |
| 208 | S-27 | P-1 | 2.62 | −0.05 |
| 305 | S-34 | P-1 | 2.43 | −0.03 |
| 309 | S-38 | P-1 | 2.47 | −0.04 |

As is evident from Table 9, in the development process P-71 wherein the black and white developing solution and the color developing solution each having bromide ion of not more than $1\times10^{-3}$ mol/l were used, occurrence of mottle was decreased, sensitivity change by the temperature in the exposure stage was small, and the amount of the replenisher was prominently reduced.

What is claimed is:

1. A color reversal image forming process using a color reversal photographic material, which comprises an exposure step, a black and white development step, a reversal step, a color development step and a desilvering step, said color reversal photographic material comprises a support and one or more silver halide emulsion layers and at least one dye-forming coupler in the said one or more silver halide emulsion layers, wherein at least one silver halide emulsion layer comprises silver halide containing chloride of not less than 90 mole %, iodide of 0 mole % and bromide of not more than 10 mole %, and the at least one silver halide emulsion layer further contains a compound represented by the formula (Ia) or (Ib):

(Ia)

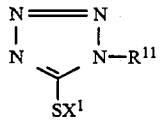

(Ib)

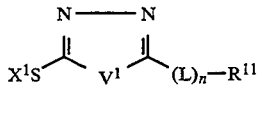

wherein $R^{11}$ is an alkyl group, an alkenyl group, a heterocyclic group or an aryl group; $X^1$ is hydrogen, an alkali metal atom, an ammonium group or a precursor thereof; $V^1$ is an oxygen atom, a sulfur atom, =NH or $=N-(L)_{n'}-R^{12}$ (wherein $R^{12}$ is an alkyl group, an alkenyl group or an aryl group, and n' is 0 or 1); L is a divalent linking group; and n is 0 or 1, and wherein the black and white development step uses a processing solution which contains chloride ion in an amount of $5\times10^{-3}$ mol/l to $1\times10^{-1}$ mol/l and substantially does not contain bromide ion, and the color development step uses a processing solution which contains chloride ion in an amount of $5\times10^{-3}$ mol/l to $1\times10^{-1}$ mol/l and substantially does not contain bromide ion.

2. The color reversal image forming process as claimed in claim 1, wherein the black and white development step uses a processing solution which substantially does not contain sulfite ion.

3. The color reversal image forming process as claimed in claim 1, wherein the black and white development step uses a processing solution which substantially does not contain rhodanide ion.

4. The color reversal image forming process as claimed in claim 1, wherein the color development step uses a processing solution which substantially does not contain sulfite ion.

5. The color reversal image forming process as claimed in claim 1, wherein the color development step uses a processing solution which substantially does not contain rhodanide ion.

6. The color reversal image forming process as claimed in claim 1, wherein the silver halide contains chloride of not less than 95 mole %, iodide of 0 mole % and bromide of not more than 5 mole %.

7. The color reversal image forming process as claimed in claim 1, wherein the silver halide emulsion layer contains the compound represented by the formula (Ia) or (Ib) in an amount of $1\times10^{-5}$ to $10^{-2}$ mole per 1 mole of the silver halide.

8. The color reversal image forming process as claimed in claim 1, wherein the divalent linking group represented by L is selected from the group consisting of $=N-R^{13}$, $-N(R^{13})-CO-$, $-N(R^{13})-SO_2$, $-N(R^{14})-CO-N(R^{15})-$, $-N(R^{14})-CS-N(R^{15})-$, $-S-$, $-C(R^{13})H-$, and $-C(R^{14})(R^{15})-$, wherein each of $R^{13}$ to $R^{15}$ independently is hydrogen, an alkyl group or an aralkyl group.

9. A color reversal image forming process using a color reversal photographic material, which comprises an exposure step, a black and white development step, a reversal step, a color development step and a desilvering step, said color reversal photographic material comprises a support and one or more silver halide emulsion layers and at least one dye-forming coupler in the said one or more silver halide emulsion layers, wherein at least one silver halide emulsion layer comprises silver halide containing chloride of not less than 88 mole %, iodide of 0.1 to 2 mole % and bromide of not more than 10 mole %, and the at least one silver halide emulsion layer further contains a compound represented by the formula (Ia) or (Ib):

(Ia)

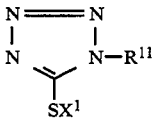

(Ib)

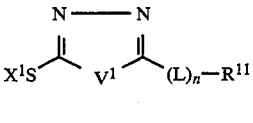

wherein $R^{11}$ is an alkyl group, an alkenyl group, a heterocyclic group or an aryl group; $X^1$ is hydrogen, an alkali metal atom, an ammonium group or a precursor thereof; $V^1$ is an oxygen atom, a sulfur atom, =NH or $=N-(L)_{n'}-R^{12}$ (wherein $R^{12}$ is an alkyl group, an alkenyl group or an aryl group, and n' is 0 or 1); L is a divalent linking group; and n is 0 or 1, and wherein the black and white development step uses a processing solution which contains chloride ion in an amount of $5\times10^{-3}$ mol/l to $1\times10^{-1}$ mol/l and substantially does not contain bromide ion, and the color development step uses a processing solution which contains chloride ion in an amount of $5\times10^{-3}$ mol/l to $1\times10^{-1}$ mol/l and substantially does not contain bromide ion.

10. The color reversal image forming process as claimed in claim 9, wherein the black and white development step uses a processing solution which substantially does not contain sulfite ion.

11. The color reversal image forming process as claimed in claim 9, wherein the black and white development step uses a processing solution which substantially does not contain rhodanide ion.

12. The color reversal image forming process as claimed in claim 9, wherein the color development step uses a processing solution which substantially does not contain sulfite ion.

13. The color reversal image forming process as claimed in claim 9, wherein the color development step uses a processing solution which substantially does not contain rhodanide ion.

14. The color reversal image forming process as claimed in claim 9, wherein the silver halide contains chloride of not less than 94 mole %, iodide of 0.1 to 2 mole % and bromide of not more than 5 mole %.

15. The color reversal image forming process as claimed in claim 9, wherein the silver halide emulsion layer contains the compound represented by the formula (Ia) or (Ib) in an amount of $1\times10^{-5}$ to $1\times10^{-2}$ mole per 1 mole of the silver halide.

16. The color reversal image forming process as claimed in claim 9, wherein the divalent linking group represented by L is selected from the group consisting of $=N-R^{13}$, $-N(R^{13})-CO-$, $-N(R^{13})-SO_2-$, $-N(R^{14})-CO-N(R^{15})-$, $-N(R^{14})-CS-N(R^{15})-$, $-S-$, $-C(R^{13})H-$, and $-C(R^{14})(R^{15})-$, wherein each of $R^{13}$ to $R^{15}$ independently is hydrogen, an alkyl group or an aralkyl group.

* * * * *